United States Patent [19]

McCain et al.

[11] 3,966,185

[45] June 29, 1976

[54] BOOK MAKING

[75] Inventors: William B. McCain, Hinsdale; James F. Cosgrove, Western Springs; Edward J. Zagorski, Chicago, all of Ill.

[73] Assignee: McCain Manufacturing Corporation, Chicago, Ill.

[22] Filed: Feb. 11, 1974

[21] Appl. No.: 441,056

Related U.S. Application Data

[60] Continuation-in-part of Ser. No. 263,944, June 19, 1972, abandoned, which is a division of Ser. No. 32,257, April 27, 1970, Pat. No. 3,717,337.

[52] U.S. Cl. ..... 270/37; 270/53; 270/54

[51] Int. Cl.[2] ..... B41L 43/12

[58] Field of Search ..... 270/53–58, 270/52, 37, 10–15, 43–44, 45, 47–51

[56] References Cited

UNITED STATES PATENTS

| | | | |
|---|---|---|---|
| 2,568,604 | 9/1951 | Bechberger | 270/54 |
| 2,793,032 | 5/1957 | Van Dusen | 270/58 |
| 3,008,705 | 11/1961 | Heigl | 270/54 |
| 3,057,620 | 10/1962 | McCain | 270/53 |
| 3,237,934 | 3/1966 | Rosenberg | 270/53 |
| 3,260,517 | 7/1966 | Sather | 270/58 |
| 3,414,257 | 12/1968 | Muller | 270/54 |
| 3,522.942 | 8/1970 | Hepp | 270/55 |
| 3,664,655 | 5/1972 | McCain | 270/54 |
| 3,730,512 | 5/1973 | Bellanca | 270/53 |

*Primary Examiner*—Edgar S. Burr
*Assistant Examiner*—A. Heinz
*Attorney, Agent, or Firm*—Kinzer, Plyer, Dorn & McEachran

[57] ABSTRACT

Books are produced by feeding juxtaposed webs of printed matter, obtained from rolls, past a glue applying means which applies glue between the webs; the webs joined by glue are cut to provide juxtaposed sheets in paginated relation which are then folded to signature form and delivered to a conveyor; preferably the conveyor in a saddle conveyor and the fold is so made as to produce signatures with a lap margin.

20 Claims, 32 Drawing Figures

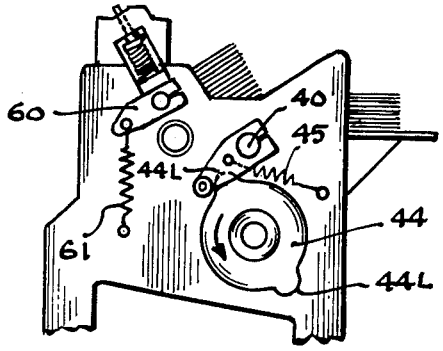
Fig.7
Fig.9
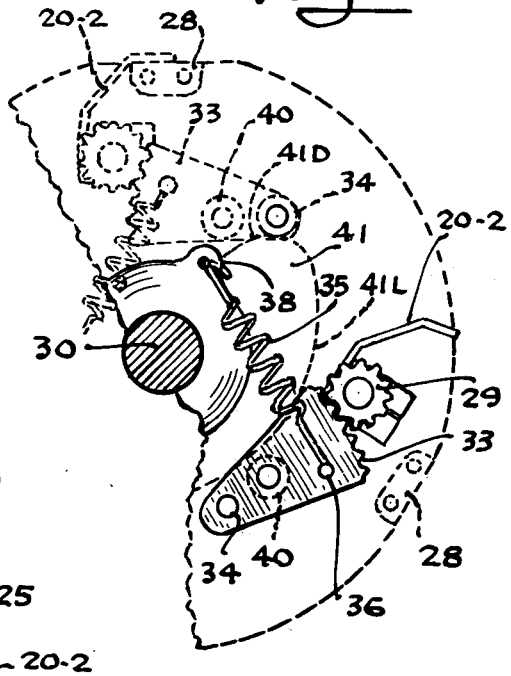
Fig.8
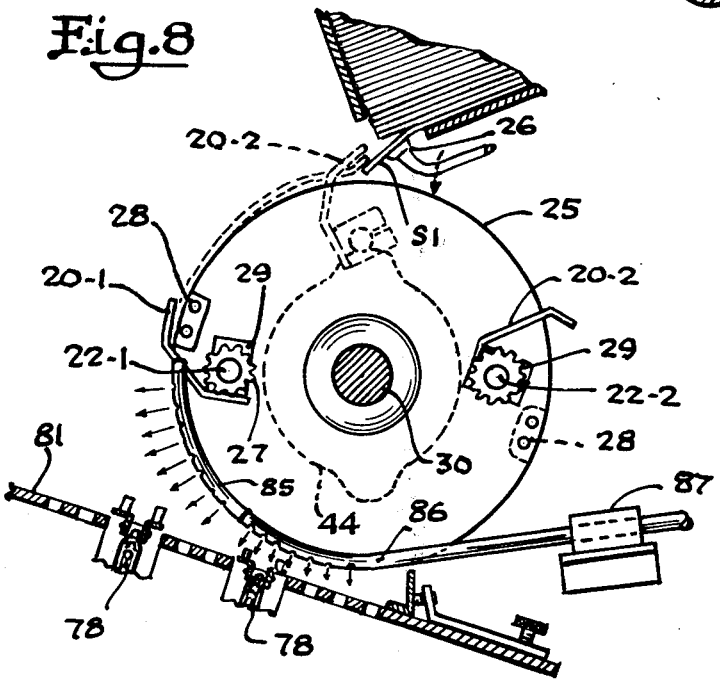

SIGNATURE FOLDER (340)
DOWNSTREAM SIGNATURE OPENER (355)
UPSTREAM SIGNATURE FEEDER (375)
LAP
340
341
343
344
345
346
347
348
349
250
251
350
355
356
357
360
361
364
365
366
367
369
375
380
382
383
384
385
386
388
389
390
391
392

BOOK MAKING

This application is a continuation-in-part of application Ser. No. 263,944 filed June 19, 1972, now abandoned in turn a division of application Ser. No. 32,257 filed Apr. 27, 1970, now U.S. Pat. No. 3,717,337.

This invention relates to sheet handling apparatus and in particular to machines for gathering signatures, a signature being a folded sheet that is to become part of a book such as a magazine.

Signature gathering machines are primarily of two kinds. There is the saddle gatherer in which the sheets of the signatures are spread apart and dropped on a support which is in the form of two plates forming an inverted V from which the "saddle" designation is derived. This saddle support extends past the hoppers or pockets from which the signatures are fed, and a conveyor chain presenting feeder pins moves along a slot at the top of the saddle support in such fashion as to move the first signature on the saddle support to the second pocket where the second signature is gathered atop the first one, the procedure being repeated at each successive pocket until all the signatures comprising the book have been gathered one atop another. The signatures thus gathered by the saddle type gatherer have their backbones or folds nested one in another and are joined by staples applied colineally with the fold line at the backbone of the book. A magazine thus produced is the familiar one where the piercing ends of the joining staples are revealed when the magazine is spread at the center. In effect the staples penetrate only half the pages.

The other principal type of signature gatherer, the flat gatherer, is characterized by feeding the signatures in flat form, on their sides, so to speak, to a conveyor. Again, the conveyor moves past the pockets which contain the signatures, and the signatures are fed out of the pockets as the conveyor moves therepast so that the signatures are collected one on top of the other. In the instance of flat gathering, the backbones of the signatures, instead of being nested one inside another, are juxtaposed one on another to present a square back rather than a V-shaped back for the book, the staples penetrating the book from front to back, transverse to the backbone; or no staples at all, as in glue binding, or perfect binding.

The present machine embodies features of saddle gathering and flat gathering in that signatures in a flat state are divaricated to fit a saddle conveyor and are then conveyed to a saddle stitcher.

Previously, and to the best of our knowledge, there have been two forms of flat gathering machines for signatures. The more traditional one is the so-called arm gatherer in which an oscillating arm having a gripper thereon withdraws the signature from a pocket and then drops the signature on the conveyor. A very complex mechanism is required in order to account for reliable operation, and in effect one-half of a cycle is lost in that the arm accomplishes no useful work during that part of the machine cycle in which it returns to the pocket to grab the next signature or sheet. This objection to the arm gatherer is obviated by the other type of flat gatherer in which a gripper on a cylinder extracts the signature from its pocket and transfers it to a second cylinder in one-half cycle of revolution. In the second half-cycle of the same or first cylinder, a second signature is withdrawn from the pocket and is transferred to the second cylinder, and during the same second half-cycle the second cylinder is depositing the first signature fed thereto on the conveyor. In effect, and for all practical purposes, no time is lost because when a sheet is moving from the first cylinder to the second cylinder, the first cylinder is ready to pick up a second sheet so that two sheets are transferred in one cycle. Nonetheless, a great deal of space is required in that there are two cylinders between the pocket and the conveyor, and the signature needs to be transferred from one cylinder to another before being dropped on the conveyor.

One object of the present invention is to so employ a unique flat gathering principle as to require minimum handling of sheet material being transferred to a conveyor, while utilizing a machine cycle to maximum advantage, in completing transfer to the conveyor. As will be shown, two sets of sheet material are transferred in one cycle, and yet only a single cylinder is used between the conveyor and the source of the sheet material. In effect, then, we combine the advantages of the two known kinds of flat gatherers while eliminating the disadvantages, and so to do constitutes another object of the present invention.

Specifically, it is an object of the present invention to create a unique flat gathering principle characterized as follows: A cylinder rotates between the conveyor to which the sheet material is to be delivered and the means which supplies sheet material. The cylinder carries grippers spaced substantially 180° apart so that sheet material is handled by the cylinder in each half-cycle of the machine. The sheet material on the cylinder is moved downwardly along an arcuate path represented by the rotation of the cylinder until it attains a releasing position just above the conveyor at which point the gripper is opened and the sheet released. At about this time the second gripper on the cylinder commences to deliver additional sheet material.

By employing this principle of rotary delivery or transfer, it is possible to transfer sheet material at an exceptionally high rate. In fact, the rate of delivery can be such that sheet material being dropped on the conveyor must be dropped atop the feeder pins which are already in engagement with the trailing edge of the previous sheet material. The principle just mentioned may be extended to produce books from roll fed webs as will be explained.

As noted above, the books produced by gathering signatures one on top of the other may be in the form of magazines. In fact, the present invention may have its greatest utility in terms of gathering signatures for magazines in a demographic sense. What we mean by demographic gathering of a signature is this: The magazine publisher may produce different forms of the same edition, which is to say that the production of the weekly edition may involve a variance in context either in geographic terms or vocational terms, or both. Thus the magazines intended for Midwest U.S.A. reading may have text matter differing from the same edition to be mailed to readers in the Southwest U.S.A. The difference may only be advertisements, but in any event demographic gathering assumes that the signatures contained in one pocket of the machine may or may not be delivered for the book being compiled. There may be variance in the same demographic sense for professions or vocations: housewives are to get a cake mix recipe whilst all unmarrieds are to get a travel advertisement.

A conveyor used to gather the signatures is usually quite long. There may be as many as 50 or 60 pockets arranged in a row parallel to the path of the conveyor. This requires a great deal of floor space, and therefore another object of the present invention is to considerably reduce the amount of floor space required for demographic signature gathering. Specifically, this object is achieved by placing at least some of the feeder pockets in tandem, themselves feeding signatures selectively (e.g. demographically) to a side conveyor which moves the signatures to the main conveyor. The main conveyor is where the signatures are gathered into the book, and it may be characteristic of either a flat gatherer or a saddle gatherer. Thus, under this object, there will be at least two pockets in tandem, one containing an A signature and one containing a B signature. One of these signatures, or neither one, may be required for the book being compiled. This arrangement of tandem pockets, feeding to a secondary conveyor transverse to the main primary conveyor on which the signatures are gathered, will be repeated in many rows transverse to the main conveyor.

For many years book binders employing signature gathering machines have been confronted with a labor cost recognized by many experts in the field as constituting a productivity impediment, an impediment which experts have sought to surmount without practical success. The impediment is that persons must be engaged in constant attendance at the signature gathering machine, loading the hoppers with signatures, and other persons must be necessarily engaged in maintaining the line of supply which literally extends to the loading dock of the plant where the signatures are printed and folded. It can be said in fact that the rate of gathering signatures is limited by the manual effort of keeping the hoppers filled.

As already noted, a large number of hoppers supplying the gathering chain presents another and quite different problem, namely space, because the usual arrangement is linear, covering a stretch of considerable length.

We have addressed these problems for a long time, particularly in terms of utilizing space to better advantage, as in our parent patent application, and also in terms of the technology set forth in U.S. Pat. No. 3,730,512, where books are produced as an incident to unwinding rolls of printed, paginated webs of paper. Under the disclosure of that patent, the webs are registered in juxtaposed relation and glue is deposited between the webs at the page separations; afterwards the webs are cut along the glue lines to produce separate, individual sheets which may then be collected and bound as case bound or perfect bound books.

We have experimented at considerable cost and time for the past several years with ways to produce glue-backed signatures as distinguished from individual sheets glued back-to-back along their free edges. We had in mind an object of the present disclosure to produce books from signatures that need not necessarily be stitched and in which production would not require hoppers for storing the signatures.

It was ultimately realized that the disclosure in our parent patent application, of which this application is a continuation-in-part, furnished a clue. The clue was the idea in said parent patent application of feeding signatures in a flat state to a so-called gathering chain which in turn would advance the signatures one-by-one to a signature opener (lap opener) where each signature is divaricated or opened as an incident to gathering like-fed signatures on a saddle-type conveyor employed for saddle stitching.

The present disclosure, then, is an elaboration and synthesis stemming from two unrelated concepts. The synthesis is the concept that the proposal of registered, juxtaposed, paginated webs as in U.S. Pat. No. 3,730,512, could be modified to create flat signature pre-forms of double page width represented by glue-joined sheets severed from the webs, fed by the aforesaid flat gatherer to a folder, folded along the glue joint to create a folded signature with a glued backbone, and the folded signature then divaricated to fit a saddle conveyor. The signature would be unusual in being folded along a glued back and presenting eight glue-interlocked pages in the instance of two juxtaposed webs of double page width.

The flat gather could feed at right angles to the saddle conveyor as in the parent patent application, allowing additional signature feeders to be used either upstream or downstream of the delivery point of the glued signature. Registration of the juxtaposed sheets would be maintained by the glue joint; the adhesive, being wet, would facilitate a good fold. By using web feed to create signatures, the problem of loading hoppers is substantially reduced.

There is perhaps no better way to maintain web registry than by holes in the webs spaced to fit pin belts. Likewise, there is perhaps no better way to divaricate a flat, folded signature to fit a saddle conveyor than to fold the signature off-center to result in an extended lap edge or margin which can be gripped as an incident to opening the signatures. Under the present invention, and as a further object, we combine these practices of web registration and signature opening in an unusual way to conserve paper (reduce waste) by having the web registry holes present at only one edge of each web and subsequently folding so that the registry openings are at the lap edge of the signature, an edge which is invariably trimmed to produce a book having a neat front. In this way, signatures with lap margins are produced, the registry holes being restricted to the lap margin which is invariably trimmed off.

The aspect of the present invention under consideration contemplates continuous production of signatures, and books composed of the signatures, by unwinding rolled webs of printed material and collating the unwound web material. This, as noted, avoids the need to attend and load many hoppers as heretofore required for gathering signatures into groups, although practice of the present invention is flexible enough to allow for utilization of ordinary hopper supply, preserving an investment. In fact, as will be appreciated from the disclosure, the invention fulfills another objective which is to introduce a new way of making books by using and therefore conserving known equipment.

Nonetheless, it was recognized from the beginning that it would be necessary from time to time to splice the trailing end of an exhausted web to the leading end of a fresh web as in the instance of producing magazines circulated to millions of readers. This splice is made at the inception of the production system, long before completion of the book. The splice involves overlapped pages representing an imperfect signature which we recognized as possibly being a flaw in the conceptual production system we wanted to reduce to practice. One though was to admit the flaw in the idea of a splice and accept the obvious proposal of stopping the machine, re-loading and starting up again, a thought which acquired some standing until we realized that our own calipering practice was the answer: make the splice, using a splicing fixture if necessary for a long splice to assure adequate lag time, then caliper for the books containing the imperfections, using caliper response to eject the imperfect books. Consequently, we were able to implement a further objective, namely, a continuous system.

Under the present invention, in the preferred mode of practice, printed webs of double-page width are unwound from rolls and accurately collated or registered in head-to-foot relation (pagination) by means of register pins fitting register holes at one edge of each web. A line or bead of glue is applied between the webs longitudinally, establishing an interlock which holds the registry. The webs as thus joined are fed to a cutting cylinder which severs the webs transversely at repeat lengths.

The bead of glue is slightly off center inasmuch as we want the register openings to be presented at a lap edge of a folded signature. To this end the severed sections are delivered to a folder, which folds the sheets along the glue line to create a signature. The presence of the glue, wetting the sheets, facilitates folding.

The resultant signature consisting of the folded sheets has a glued backbone. The signature is fed from the folder to a lap opener of known form where the glue-backed signature is divaricated to fit a saddle conveyor to which it is delivered as an incident to divarication.

Other signatures may be added upstream or downstream of the point of delivery of the glue-backed signature and are gathered into a book on the saddle conveyor. The book group is calipered for the presence of a signature having a splice. Thereafter the signature group is conveyed to a saddle stitcher.

In the instance of using a saddle stitcher, if an imperfect signature having a splice is detected, the stitcher heads are disabled for that particular signature group. The signature group containing the imperfect signature is ejected.

After passing the stitcher head, the bound signatures are delivered to a trimmer where the lap edge containing the register holes is separated as waste. The head and foot may also be trimmed.

The preferred mode of production may be varied, of course, and other modes of production may be employed. Therefore, other and further objects of the present invention will be apparent from the following description and claims and are illustrated in the accompanying drawings which, by way of illustration show preferred embodiments of the present invention and the principles thereof and what is now considered to be the best mode contemplated for applying these principles. Other embodiments of the invention embodying the same or equivalent principles may be made as desired by those skilled in the art without departing from the present invention or from the subject matter of the claims.

In the drawings:

FIG. 7 is an end elevation on a reduced scale substantially on the line 7—7 of FIG. 2;

FIG. 8 is a detail elevation showing the sheet grippers;

FIG. 9 is a fragmentary elevation similar to FIG. 8 showing the manner in which the sheet grippers are operated;

Figure 30:
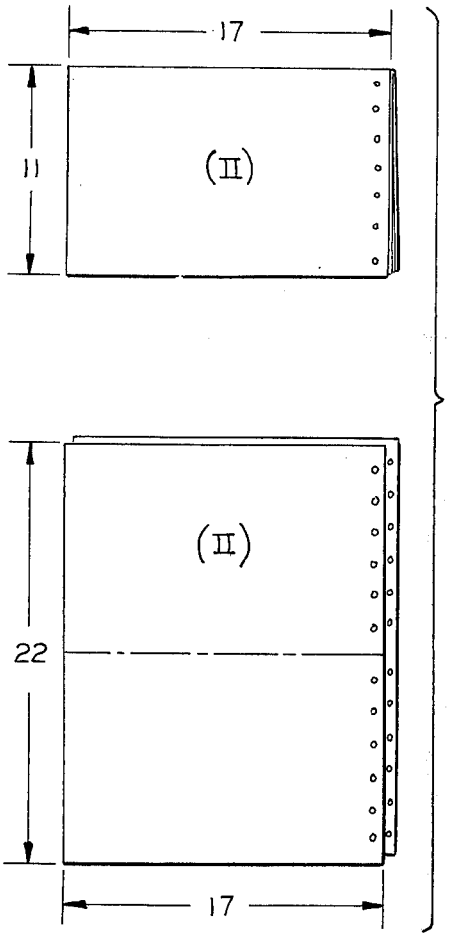

FIG. 30 presents plan views of another form of book production possible under the present invention.

Figure 1:
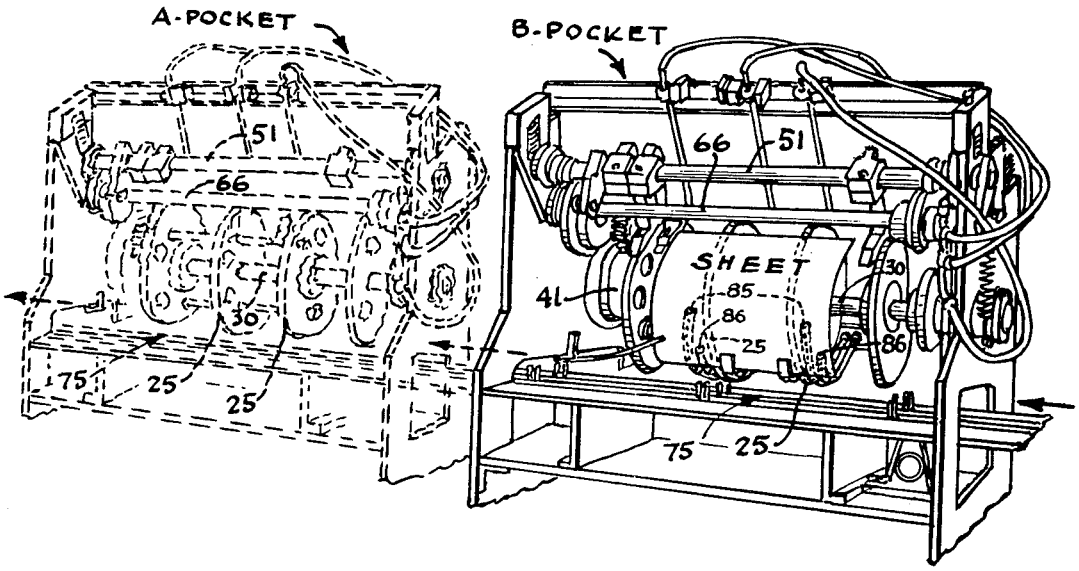
FIG. 1 is a perspective view of a signature gathering machine constructed in accordance with the present invention.
Figure 2:
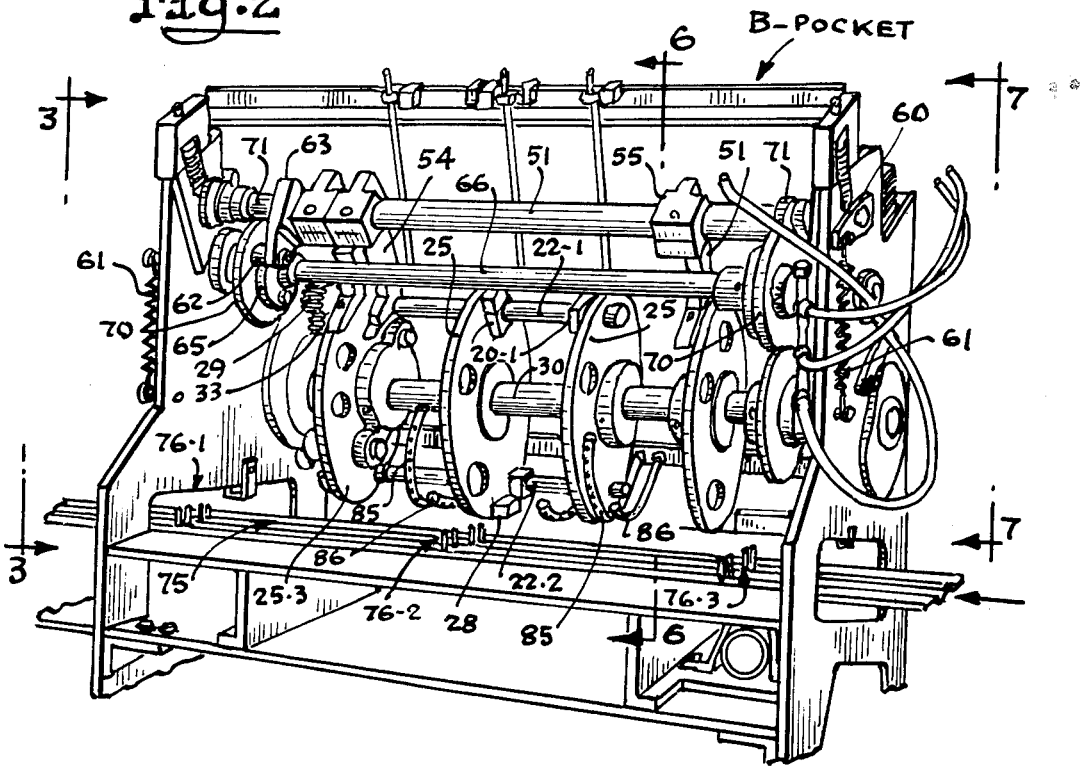
FIG. 2 is an enlargement of a portion of the structure shown in FIG. 1.

While the form of machine shown in FIG. 1 is disclosed in terms of flat gathering of signatures in a demographic sense, either from an A pocket or a B pocket, nonetheless the principles may be applied to a single hopper, the B pocket, FIG. 2, containing a supply of sheets to be fed rapidly to a conveyor. Since the construction and operating principles are identical for both feeder pockets, whether signatures are fed or plain sheets are fed, we will first describe in detail the B pocket arrangement and then we will describe how the invention may be used for demographic signature gathering.

Figure 6:
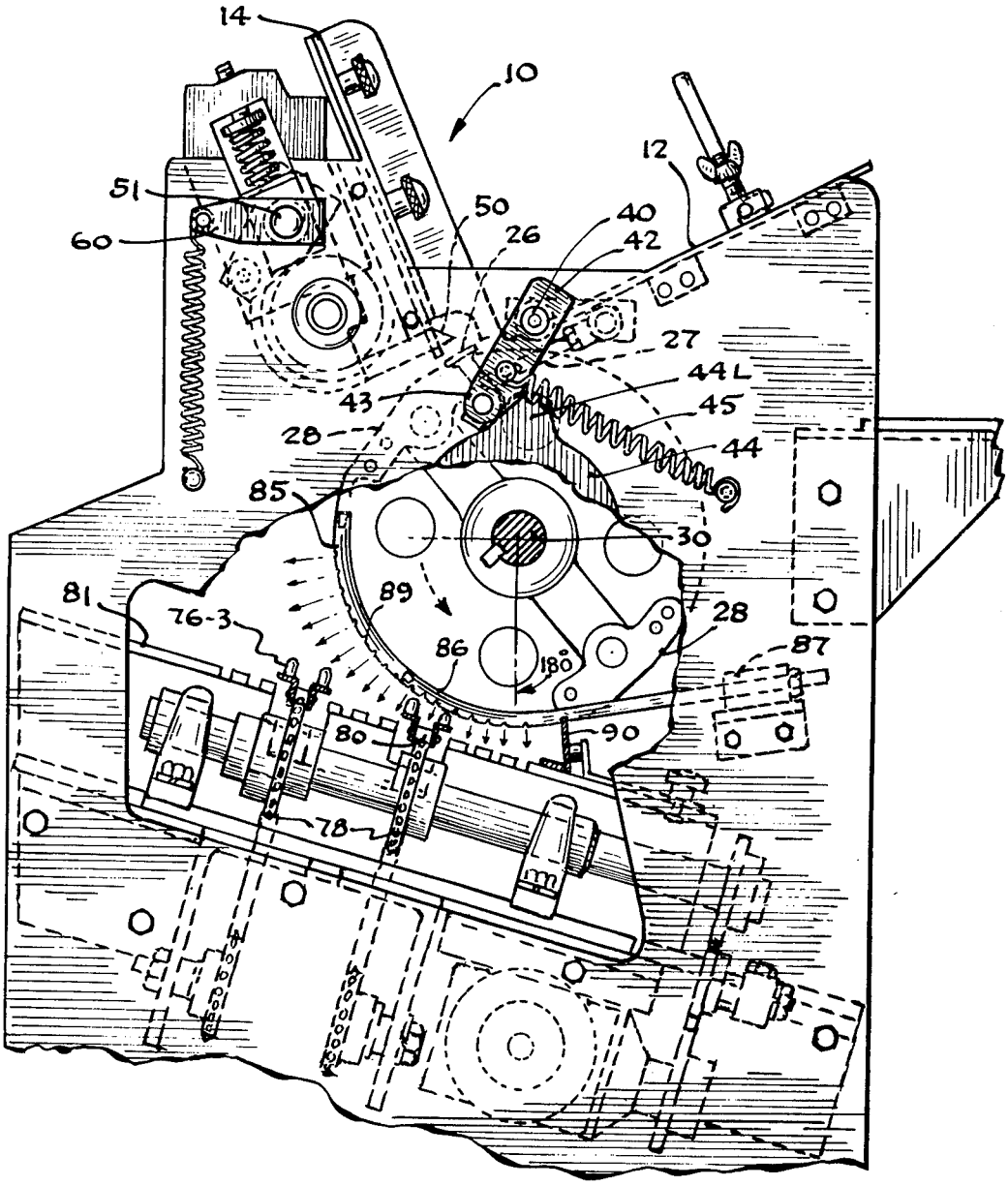
FIG. 6 is a sectional view on the line 6—6 of FIG. 2.

The supply of sheets will be contained in a forwardly and downwardly inclined hopper 10, FIG. 6, characterized by a bottom support plate 12 and a forward stop plate 14. The bottommost sheet in the stack is to have the leading edge thereof presented to one of two gripper means 20-1 and 20-2, FIG. 8. The gripper means 20-1 are carried on a rock shaft 22-1, and the gripper means 20-2 are carried on a rock shaft 22-2, FIGS. 2 and 8 which rotate with a cylinder or disc 25, of which there are two, FIG. 2, constituting the extracting cylinder. Advantageously the sheet is presented to the gripper by a suction cup 26 supplied by a conduit 27.

Before describing in detail the distinctive structure and functional characteristics of the present invention, it is appropriate to consider the known construction and operation of the gripper fingers 20-1 and 20-2 carried by the discs 25. Each such finger and its associated parts are identical, and attention is now directed to FIG. 8 wherein it will be observed that each finger or gripper is normally in an open position with respect to a flat anvil or plate 28 carried on the disc 25. This is the condition prevailing at the time a gripper finger is approaching the exposed edge (or backbone) of the sheet (or signature) adjacent the front of the supply hopper 10, but the concurrent event is that the gripper finger is then to be moved immediately to a closed position to clamp the edge of the sheet to the opposed anvil surface 28. It will be appreciated that this is an accurately timed operation as will be apparent from the description to follow.

Figure 3:
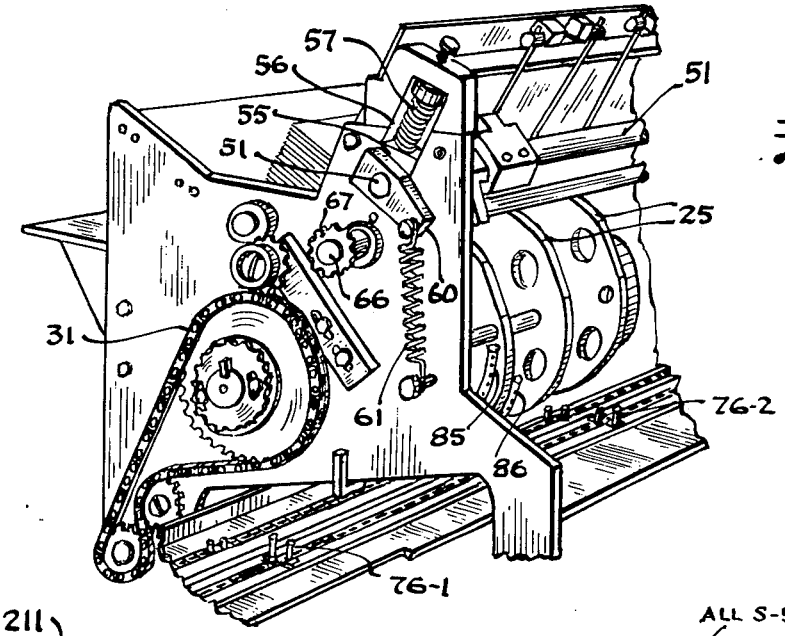
FIG. 3 is a fragmentary perspective view substantially on line 3—3 of FIG. 2.

There is a gripper finger on one disc 25 directly opposite and paired with an identical gripper finger on the other disc as shown in FIG. 2. Each gripper finger is supported by a bracket 29, FIG. 8, which in turn is clamped to the related rock shafts 22-1 and 22-2 carried by and extending between the discs 25. The supporting rock shafts extend parallel to the main drive shaft 30 to which the discs 25 are keyed or otherwise affixed for rotation therewith. Thus, rotation of the shaft 30, through a drive chain 31, FIG. 3, is effective to rotate the discs 25, and the rock shafts which carry the gripper finger assemblies are carried along in a planetary sense.

A third disc 25-3 is carried by shaft 30, FIG. 2, and this disc carries means including gears for oscillating the rock shafts 26-1 and 26-2 which support the grippers, as will now be described.

Each rock shaft is provided at one end, outboard of disc 25-3 with a pinion gear 29, FIGS. 8 and 9, as mentioned. Each pinion is meshed with a segment gear 33. Each such segment gear 33 is pivotally supported on a stub shaft 34, FIG. 9, supported on the left-hand side of disc 25-3 as viewed in FIG. 2, and is biased by a spring 35 anchored at one end to a pin 36 on the segment gear and at the opposite end to a projecting ear 38 on a hub element 39 keyed to the disc 25-3 for rotation therewith. This arrangement prevails for each segment gear.

Each segment gear as 33 has a cam follower 40 thereon located between the pivotal mounting of the segment gear and the end thereof presenting the segment gear teeth. The cam followers 40, of which there are two, one for each of the segment gears, travel in aa revolving sense about and in contact with a stationary cam 41, FIG. 9, mounted on the inside face of the side plate of the machine. The general contour of this cam presents a long lobe 41L and a shorter dwell 41D, FIG. 9.

Each spring 35 is effective, when the follower 40 rides on the cam dwell 41D, to pivot the segment gear inward toward the axis of disc 25-3 imparting rotation to the pinion 29, causing the gripper finger as 20-2 to pivot in a closing direction toward the related anvil 28. This action takes place at a time when a signature or sheet as S1, FIG. 8, is in temporary holding position, presented by the suction cup, whereupon the two activated fingers 20-2 (one on each disc 25) grab the presented edge of the thus positioned sheet and transfer the sheet from the supply hopper to the extracting cylinder. Continued rotation of the extracting cylinder carries the sheet along until the cam follower of the activated gripper finger encounters the lobe 41L of the cam 41, FIG. 9, whereupon each corresponding segment gear is oscillated in a direction opposite to that induced initially by the spring 35, manifest in an opening movement of the gripper finger which releases the signature.

It was mentioned that the suction cup 26 (of which there may be as many as six) is supplied by a conduit 27. The suction cups are carried on a support bar (not shown) supported for swinging motion on a rock shaft 40, FIG. 6. The rock shaft 40 at one end is provided with a depending arm 42, having a cam follower 43 tensioned against a cam 44 by a spring 45. The cam is fixed to shaft 30 to rotate therewith, and has a lobe 44L, there being two such lobes 180° apart, FIG. 7.

When a lobe 44L is presented to the cam follower 43, the rock shaft 40 is rocked clockwise as viewed in FIG. 6 shifting the suction cups upward to engage the underside of the lowermost sheet or signature in the hopper and concurrently vacuum is established in the suction cups 26. Resultantly the suction cups 26 are effective to pick up the exposed portion of the lowermost sheet in the hopper 10. When the dwell or low part of the cam 44 is presented to the follower 43 as shown in FIG. 6 spring 45 is effective to turn rock shaft 40 in the opposite direction, pulling the suction cups 26 downward so that the leading edge of a sheet or signature as S1, FIG. 8, is in position to be grabbed by a gripper. The supply of vacuum is then discontinued.

In some instances it may be advantageous to aid the effectiveness of the grippers by lifting the pile of signatures or sheets in the hopper substantially concurrent with the grippers as 20-1 or 20-2 as the case may be, withdrawing the bottommost sheet, presented by the suction cups 26. To thus lift the remainder of the pile or supply is not always necessary, but the present machine is equipped to so do, and referring to FIG. 6 a plurality of pile separator fingers 50 have inner beveled ends presenting relatively sharp points adapted to penetrate the supply of sheets to separate the bottommost sheet from the remainder of the supply above. Thus the separator fingers are to have a horizontal inner stroke and an upward vertical stroke, and to this end the separator fingers are supported from a vertically shiftable rock shaft 51, FIG. 2.

Each finger 50 projects inward from the lower end of a support arm 54, and the upper end of the support arm is provided with a clamp head 55 which is clamped to the rock shaft 51. The ends of the rock shaft 51 are supported in square guide blocks as 55, FIG. 3, confined for vertical motion in elongated guideways 56 formed in the side plates of the machine. Coil springs 57 in the guideways 56 apply tension to the guides 55, normally tending to bias the latter to a lowermost position in the guideways 56 characterizing the at-rest condition of the separator fingers 50.

The end of each rock shaft 51 is also provided with an arm 60 secured thereto, FIGS. 3 and 6, and the free end thereof is tensioned by a coil spring 61, FIG. 3, so that a cam follower 62, FIG. 2, on an arm 63 clamped to the rock shaft 51 is normally held against a cam 65. Cam 65 is secured to a cam shaft 66, and referring to FIG. 3 cam shaft 66 is provided with a sprocket 67 adapted to be driven by a chain (not shown).

The cam shaft 65 also carries a pair of cams 70 engageable with followers 71 on rock shaft 51, and the cams 70 are effective to raise and lower rock shaft 51 guided by the blocks 55 in the guideways 56.

Cam 65, on the other hand, is adapted to produce oscillation of rock shaft 51 characterizing in and out motion of the pile separator fingers 50.

The timing arrangement is such that just after the suction cups 26 have been effective to pull the bottom-most sheet or signature downward to present it to the grippers on the extracting cylinder, the pile separators 50 are moved inward and then upward to take the weight of the pile off the sheet being withdrawn by the grippers in their closed position on the anvils 28.

Referring to FIGS. 6 and 8, it will be appreciated a sheet withdrawn from the hopper moves downward with the turn of the extracting cylinder along an arcuate path. The signature thus withdrawn is to be deposited on a conveyor 75 characterized by longitudinally spaced sets of feeder pins 76-1, 76-2 and 76-3, FIG. 2. The spacing between the pins is slightly greater than the length of the sheet to be dropped on the conveyor between the sets of pins. For example, the sheets may be 11¼ inches long and the spacing between the pins only 12 inches, so it becomes crucial to high speed operation to deposit the sheet accurately in the space assigned thereto on the conveyor. Assuming for example that in the sequence of operation, FIG. 2, three sheets are to be fed from the hopper 10, one after another, the first sheet would have its trailing edge engaged by the pins 76-1, the second sheet by the pins 76-2, and the third sheet would be fed by the pins 76-3. There are two sets of grippers within the 360° circumference of the extracting cylinder, and hence two sheets may be extracted from the hopper 10 per cycle of revolution. Therefore, three sheets would be fed in one and one-half cycles.

The feeder or conveyor pins are carried on endless chains 78 and move in elongated slots as 80 provided in a support table 81, FIG. 6. The drive means for turning the chains need not be described, inasmuch as any convenient mode may be employed, constituting no part of the present invention.

Under and in accordance with the present invention, the sheets are deposited accurately in the assigned area on the conveyor by making provision for a radially directed air blast against the upper side of the sheet so that it in effect is forcefully driven downward toward the support table 81. In accomplishing this, we provide a plurality of air tubes including a long tube 85, and a shorter tube 86, FIG. 6, positioned close to the discs 25. The tubes 85 and 86 are supplied constantly with air under pressure from a header 87, and each is provided with a plurality of openings 89 in alignment along the arc at the underside of the tubes. Advantageously, there are a pair of such tubes associated with each of the discs 25 constituting the extracting cylinder as best shown in FIG. 2, although more may be employed.

Experience shows that a long tube and a short tube in combination produce reliable and consistent results. Additionally, we have found that a superior performance is achieved by having the air tubes 85 and 86 bent on arcs having a radius slightly less than the radius of the extracting cylinder.

The releasing point of the signature is near the bottom of the extracting cylinder, FIG. 6, which is to say that when the edge of the sheet held by the grippers is approximately at the 180° position, FIG. 6, the grippers are opened. Escape of the sheet is prevented by an adjustable register gauge or stop 90, FIG. 6. The released sheet is in a floating condition, in which state the air blast from the tubes 85 and 86 in effect amounts to a hand (or two hands) forcing the sheet downward into its assigned area. Nonetheless, the timing and orientation is such that when the sheet falls onto the feeder pins, the front or leading portion of the sheet (considered in terms of the forward movement of the feeder pins) falls atop the pins which are in leading position, the sheet then "drifting" into the area immediately therebehind. Thus, and referring to FIG. 2, if the sheet is to be in the area between pins 76-2 and 76-3, eventually to be fed along by the pins 76-3, then this sheet, when released, will actually fall with its leading portion atop pins 76-2.

It will be seen from the foregoing that the sheet feeder of the present invention is somewhat unusual in that the sheets are deposited in a flat state on a longitudinally movable conveyor by means including a transfer or extracting cylinder which extracts two sheets or signatures from a hopper per cycle of revolution. No intervening cylinder is required insofar as concerns transfer of sheets from the hopper to the conveyor. If the disclosure be confined or restricted to what is shown in FIG. 2, compared to the tandem arrangement shown in FIG. 1, the machine may be viewed as an unusual form of sheet feeder for feeding sheets from a hopper to a conveyor at a high rate of speed. However, the principal form of utility of the present invention may be in connection with signature gathering, in which event there will be two machines in tandem or side-by-side relationship as shown in FIG. 1, respectively affording an A pocket and a B pocket, operating independently, but feeding signatures selectively to the feeder pins of the conveyor. The two machines are identical in construction and operate precisely in the manner as described in detail.

Figure 5:
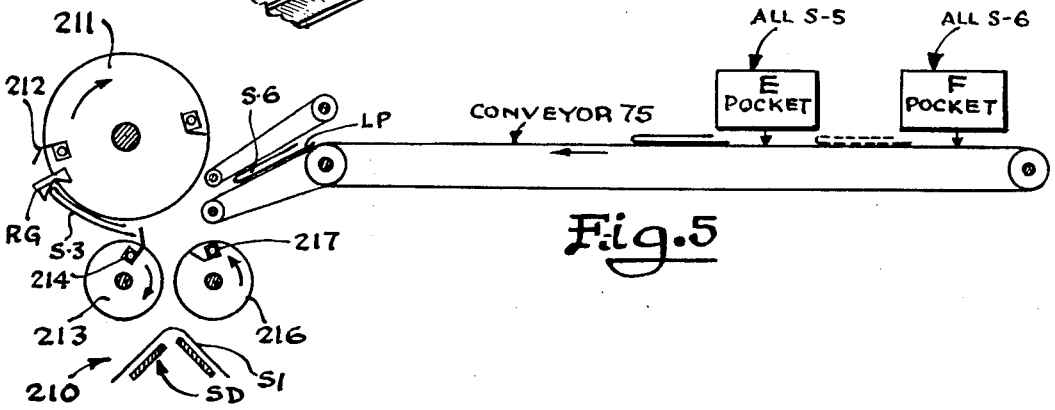
FIGS. 4 and 5 are schematic views showing an extension of the present invention.
Figure 4:
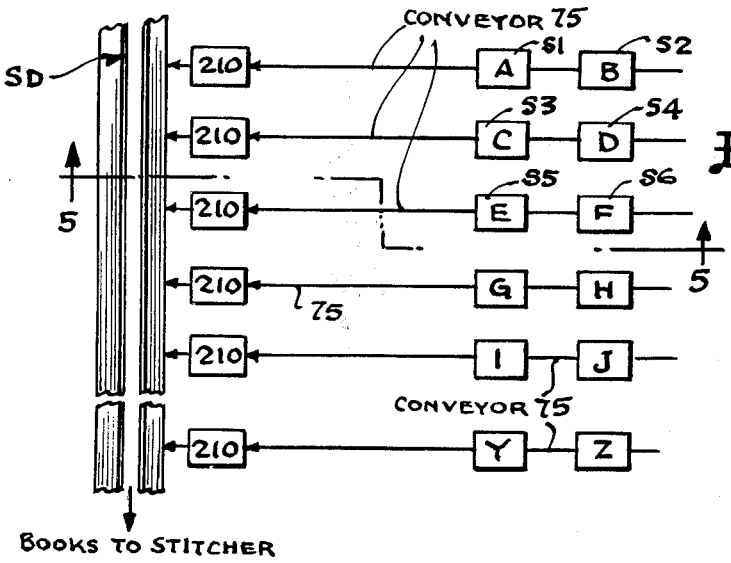

Attention is therefore directed to an extended consideration of the A pocket - B pocket arrangement of FIG. 1, more extensively considered in FIGS. 4 and 5.

In FIG. 4, the reference character SD identifies a so-called saddle gatherer or conveyor as the primary conveyor on which signatures are collected to form books. However, the primary conveyor may also be a flat gatherer or conveyor, and the saddle conveyor SD has been selected only to demonstrate that the features of the present invention so far described may be applicable to either a saddle gatherer or a flat gatherer for collecting the signatures into a book.

The ordinary circumstance prevailing in connection with magazine publishing is that the hoppers or pockets which contain the signatures are arranged in side-by-side relationship, one next to the other, along the length of the primary conveyor as SD. Thus, in the normal arrangement the pockets or hoppers A, B, . . . Y, Z, FIG. 4, will be strung out along the length of the saddle conveyor SD, and in the instance of demographic gathering the hoppers or pockets are selectively controlled to feed a signature which is to be part of the book being compiled. The normal arrangement can occupy a great deal of floor space, but under the present invention the length is considerably reduced in the direction of the primary conveyor.

Thus as shown in FIG. 4, the A pocket and B pocket tandem arrangement is repeated many times over: C, D; E, F; and so on through the alphabet, terminating say at the paired feeders Y, Z. This amounts to twenty-six pockets, two in a row making 13 rows. Each pair of pockets or hoppers feeds a conveyor 75, precisely in the manner in which this has been described in detail in connection with FIG. 2, noting that the secondary conveyors 75 project at right angles to the length of the saddle conveyor SD. Thus, the saddle conveyor may be viewed as the main stream of collected signatures, and the secondary conveyors 75 may be viewed as tributaries of the main stream.

Consideration may now be given in the manner in which a book will be compiled from the signatures in a demographic sense. The paired pockets, FIGS. 4 and 5, may be arranged in tandem in the manner shown in detail in FIG. 1. The A pocket, for example, will only feed signatures S1, and the related B pocket will only feed signatures S2. Pocket E feeds S5 signatures, pocket F feeds S6 signatures, and so on.

The signatures on a conveyor 75 are moved forward to a signature transfer apparatus 210 which is characteristic of the saddle type gatherer, noting that a signature S6, FIG. 5, has been fed from pocket F. Also, as shown in FIG. 5, the transfer apparatus 210 includes a transfer cylinder 211 having a gripper 212 thereon adapted to clamp the backbone of the signature and then release it to a back register gauge RG. The signature is transferred from the register gauge RG to an extracter cylinder 213 having a gripper 214 thereon which clamps the lap of the signature in a register gauge and extracts it therefrom. An opening cylinder 216 is opposite the cylinder 213 and is provided with an opener finger 217 which moves between the two sheets of the signature carried by the cylinder 213 to spread the sheets so that the latter will straddle the saddle SD when released by the cylinders 213 and 216.

FIG. 5 shows several different stages in the collection of signatures to compile the book. The signature S1 has already been deposited on the saddle conveyor SD. This signature S1 has been earlier fed from the A pocket. It will be noted in FIG. 5 that the signature (S3) next to become part of the book SG is in the register gauge ready to be extracted by the gripper 214. Thus, signature S1 has been moved by the conveyor to the extracter unit 210 associated with the two pockets C, D, and a signature S6 has been fed from F pocket to its conveyor 75 in the process of being advanced to the associated transfer apparatus 210. The book being compiled, containing signatures S1, S3 and S6 is not to contain signatures S2, S4, and S5. When all the signatures have been collected for a single book, the book is in condition to be stitched, FIG. 4.

Thus, it will be seen that the present invention has many ramifications, and in this connection it may be observed that the form of the invention considered in FIGS. 4 and 5 assumes that the conveyor 75 extends parallel to the axis of shaft 30. However, it is possible to alter the arrangement so that the conveyor 75 travels along an axis at right angles to the axis of each pocket or shaft 30, in which event one pocket will be in front of the other rather than in the side-by-side relationship shown in FIG. 1.

In the form of the invention shown in FIG. 1 and contemplated by FIGS. 4 and 5, it will be recognized that the primary conveyor can accept signatures from both pockets A and B provided that the cylinders 25 associated therewith are in phase, in which event (and referring to FIG. 4 for the moment) a signature S1 would be delivered to the conveyor 75 from pocket A concurrently with a signature S2 being delivered to conveyor 75 from pocket B. Of course, the transfer apparatus 210 must be phased or timed appropriately to receive the signatures being delivered thereto at the terminus of each related tributary conveyor 75. However, it may be noted that in most instances the arrangement will be such that for any given book a signature is to be fed from either A pocket or B pocket or neither pocket, and in no event will signatures be fed concurrently to the conveyor 75 from both pockets.

Of course it becomes necessary to control the pocket feed in the sense of feeding or not feeding a signature depending upon the content of the book being compiled. Insofar as a "feed" or "no-feed" command signal can be concerned, we can adopt the disclosure in U.S. Pat. No. 3,608,893, which is to say that the delivery suction cups 26, FIG. 6 hereof, may be latched in an ineffective position when the signature is not to be delivered from the related hopper.

It will be seen from the foregoing that the cylinder feeder of the present invention, FIG. 2, possesses utility of different orders in that it may be used as a high rate sheet feeder (as elaborated on hereinbelow) or it may be combined with a second pocket, FIG. 1, for feeding sheets selectively to a main conveyor, signatures or otherwise. Further, while the present machine itself is definitely a flat gatherer in terms of signature feeding, it can nonetheless be used to feed the tributary conveyor selectively with signatures which are to be compiled by another gatherer, FIGS. 4 and 5, which may be a saddle gatherer or a flat gatherer.

Regardless of the use to which the pocket feeder is put, the arrangement enables two sheets or signatures to be fed per cycle of revolution of the extracting cylinder so that in effect there is always a sheet or signature on the extracting cylinder, one sheet in the process of being extracted while the other sheet is in the process of being released to the conveyor.

PRODUCTION OF GLUE-BACKED BOOKS FROM ROLLED WEBS

Figure 10:
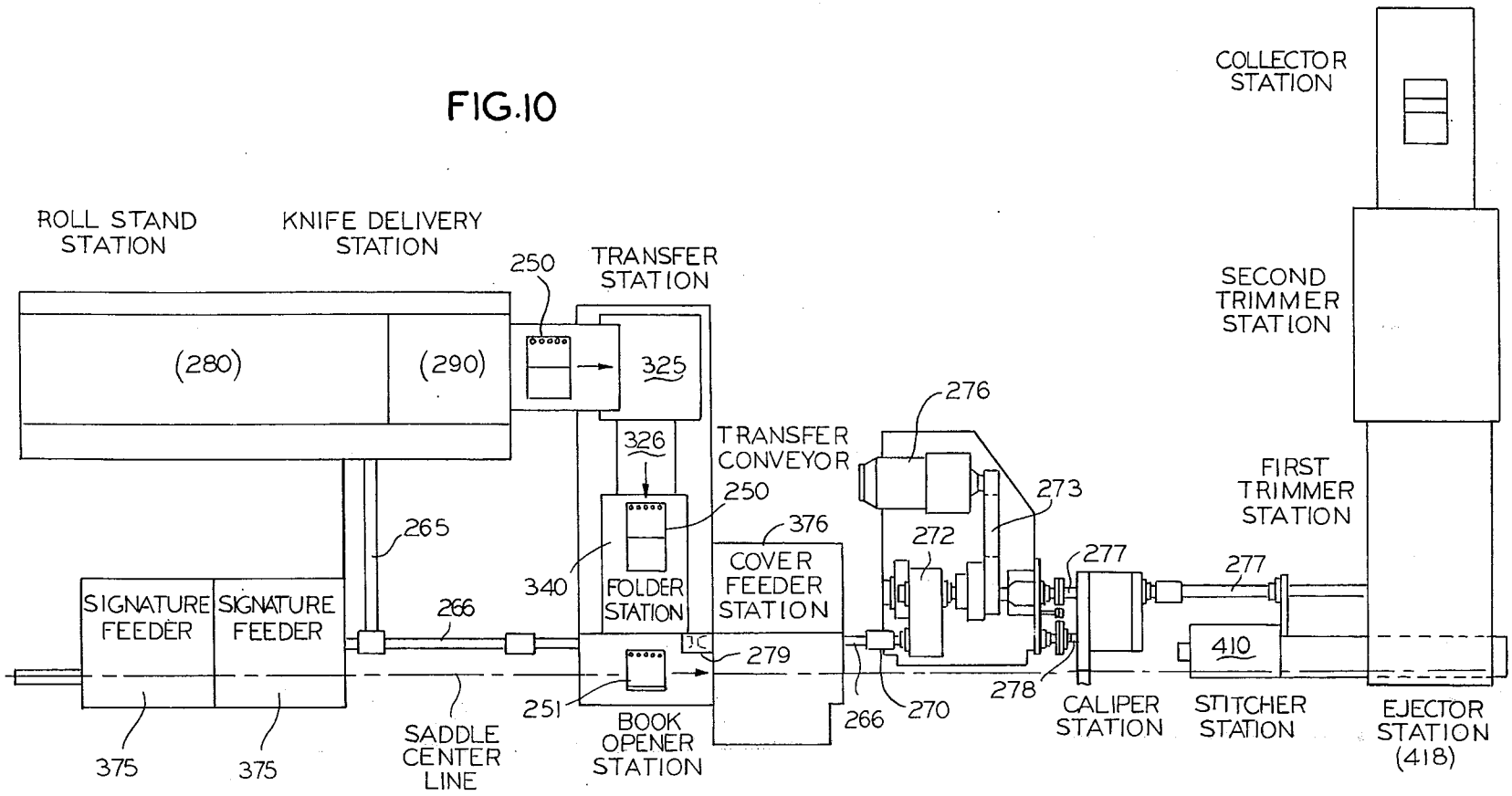
FIG. 10 is a partly diagramatic and partly schematic drawing of the means employed under the present invention to make signatures and produce books therefrom.
Figure 11:
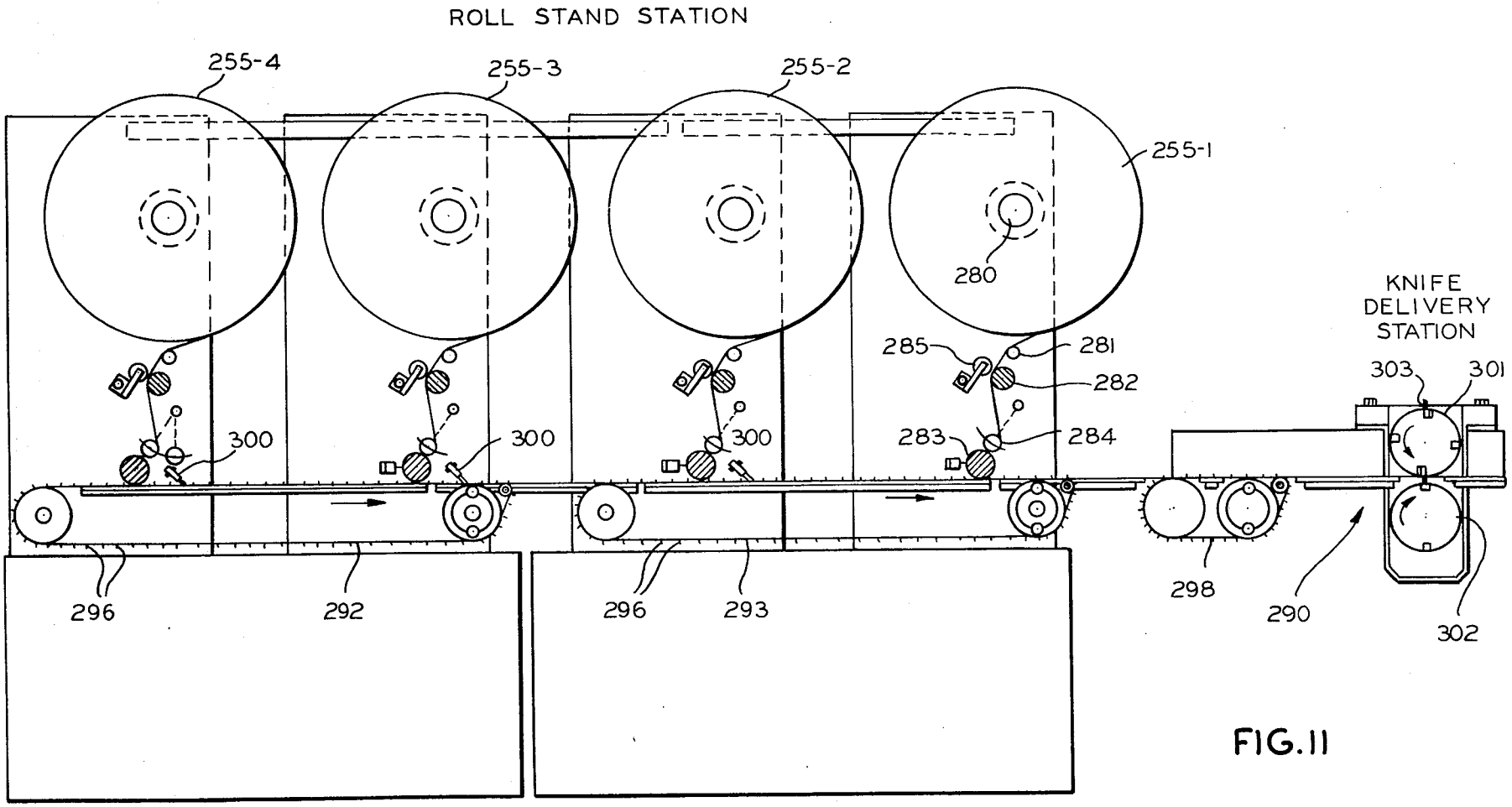
FIG. 11 is a sectional view of the roll stand and the knife delivery means.

FIG. 10 is a schematic, partly diagramatic plan of a system for producing glue-backed books from rolled webs. The rolls of web material, pre-printed in page relation, are assembled at a roll stand station. As shown in FIG. 11, the webs are withdrawn from individual rolls, glued, collated, and fed to a knife delivery station where the registered webs are severed transversely. The product obtained at the knife delivery station may be viewed as a multiple page pre-form signature, one not yet folded, but in any event a multiple page assembly of sheets, identified by reference character 250 in FIG. 10. This signature pre-form is advanced to a transfer station, FIG. 10, and from thence at right angles along a different path to a folder station by way of a transfer conveyor. The sheet material transferred to the folder station is essentially in the same form, 250.

The juxtaposed sheets are folded into signature form and fed to a book opener, FIG. 10, thereby preparing the book 251, FIG. 10, for delivery to a saddle conveyor. The book has a glued back.

As shown in FIG. 10 individual signature feeders may be located upstream of the book opener and a cover feeder may be located downstream. In other words, the glued book at the book opener station may itself be deposited atop signatures delivered by the saddle conveyor to the book opener station, and afterwards a cover (in reality another signature) may be juxtaposed at the cover feeder station.

The book thus assembled from the gathered signatures is delivered by the saddle conveyor to a caliper station and from thence to a stitcher station which will be utilized only in the event the upstream signature feeders and/or the cover feeder are active. Thus, if the only product is the glued back book 251, FIG. 10, the stitcher heads will not be activated; however, if another signature is to be gathered with the book 251, then the stitcher station will be activated.

If an imperfect book is detected by the caliper, the stitcher heads, if used, are disabled; the insufficient book is discarded at the ejector station, FIG. 10, prior to delivery to the trimmers where the front, head and foot of the book are trimmed, resulting in the finished product.

In FIGS. 20 through 24, the stages of constructing or composing the glue-backed book (sixteen pages) are shown. Assuming there are four roll webs at the roll stand, rolls 255-1, 255-2, 255-3 and 255-4, the webs unwound are, respectively, 256-1, 256-2, 256-3 and 256-4. In connection with the disclosure thus far made, it is important to bear in mind that the unwound webs are fed forwardly in the direction of the arrows shown in FIG. 11. Web 256-1 is laid down first on a pin register belt as will hereinafter be described, and the remaining webs, in the order identified, are juxtaposed one atop the other on web 256-1.

Figure 20:
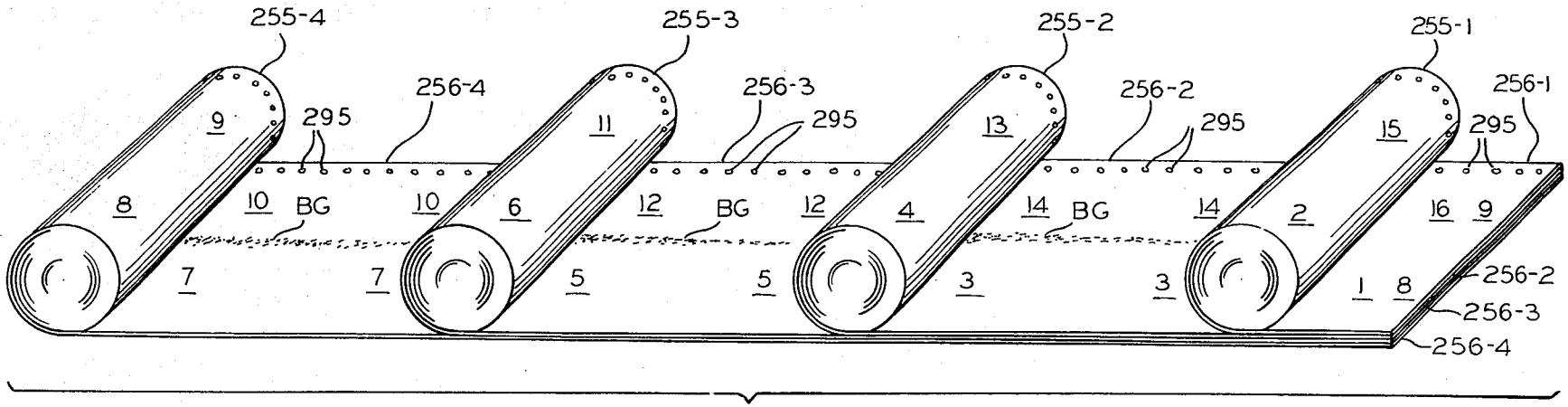
FIGS. 20 through 24 are views showing the steps of book production.

A representation of pagination is shown in FIG. 20. The webs are of double page width, printed on both sides, so that roll 255-1 may be considered as printed on one side with pages 1 and 16, pages 2 and 15 appearing on the reverse side. The remaining webs are correspondingly paginated to produce a sixteen page book.

Figure 21:
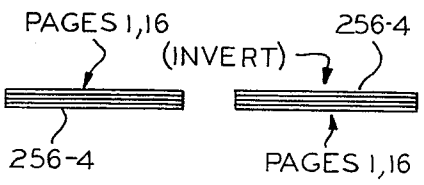

When the webs are juxtaposed and properly registered, FIG. 21, there is a constant stream of signature pre-forms being produced at the knife station. It must be remembered, however, that the illustration given for pagination is related to only one form of production herein disclosed wherein four rolls are used and wherein the juxtaposed sheets are inverted as hereinafter disclosed, among other things.

Figure 22:
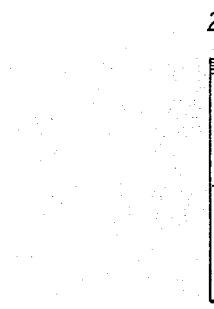
Figure 24:
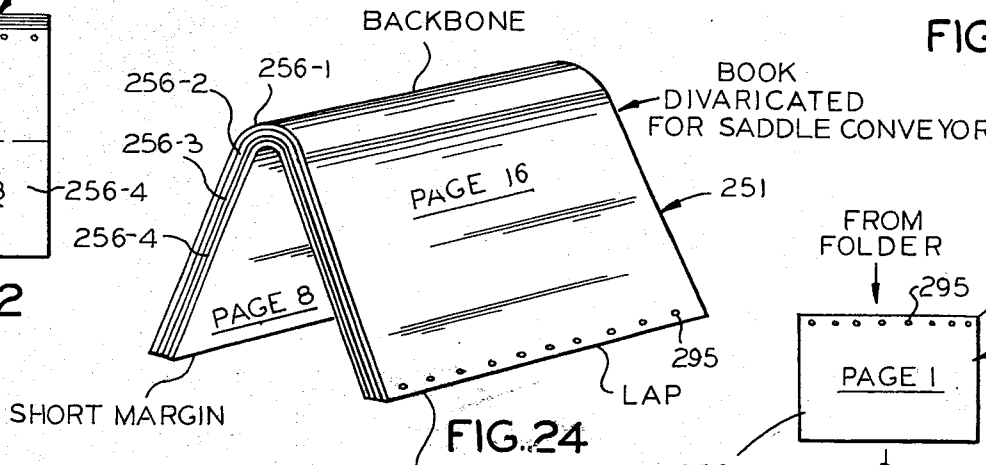
Figure 23:
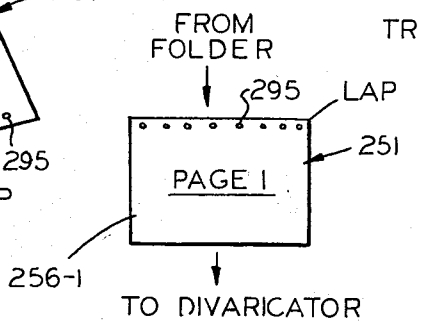

As shown in FIG. 10 and as mentioned above, the pre-form book or signature product emerging from the knife station is identified by reference character 250; it is two pages wide, not yet folded at the backbone. At the transfer station this product, considered as a juxtaposition of four sheets, is inverted, FIG. 21, and transferred to the folder station at right angles to its original delivery path as shown in FIG. 22. This sheet assemblage is folded for delivery to the book opener station and the folded product is identified by reference character 251 in FIGS. 10 and 23. At the book opener or divaricating station, the previously folded book is opened, FIG. 24, incidental to depositing it on the saddle conveyor.

As will be evident from the disclosure to follow, parts comprising the transfer station, transfer conveyor and book opener station, FIG. 10, correspond in many respects to what has already been described in connection with FIGS. 1 to 9.

The four rolls are supported on spindles 280. The unwound length of the web is trained about an idler roll 281, then around an infeed roll 282 and from thence between a guide roll 283 and associated dancer roll 284, the latter being used as a control brake to regulate the rate of web feed. Roll 283 guides the web onto a pin register belt to be identified below.

The feeder roll 282 is driven positively so that it together with an associated nipper roll 285 is responsible for withdrawing and feeding the web material from the web rolls to the pin register belt.

The web material is advanced in the direction of a rotary knife assembly 290, FIG. 11, constituting the knife delivery station, and this is accomplished by laying the webs, one atop another, on a pair of tandem end-to-end pin register belts 292 and 293 travelling beneath the spindles. At the commencement of a run, the leading ends of the webs are accurately registered in page to page relationship by the supervisor, and this is accomplished in part by providing punched, pin register openings 295 spaced equidistantly from one another along one edge of each web. The register belts 292 and 293 are provided with feed pins 296, spaced in accordance with the register openings 295. The register openings are only at one edge of the webs for reasons to be explained.

The pin feeders 292 and 293 simply perform a registering and collecting function. Thus, the principal means for feeding and advancing the webs is represented by the engaged rollers 282 and 285; the pin register belts do not pull the web material from the rolls but merely maintain forward motion of the juxtaposed webs, moving the juxtaposed webs forwardly to a third register pin belt 298 which advances the juxtaposed webs to the knife assembly 290.

In accordance with the present invention, a bead of glue BG, FIG. 20, is deposited substantially midway of the width of each of the webs 256-2, 256-3 and 256-4. In other words, the bead of glue separates adjacent printed pages on a web. The bead of glue is slightly off center, in view of the way the juxtaposed sheets are to be folded, and for this same reason the register openings are confined to one edge of the webs. Thus, the register openings serve no purpose in the completed book and may be trimmed off. This being so, and since we desire to conserve investments already made in equipment for producing saddle-bound books, each bead of glue is deposited continuously and longitudinally on the line which constitutes the glued backbone of the book (see FIG. 24); hence when a signature is made the register openings are presented at what constitutes the extended lap margin (see FIG. 24) of the folded sheets.

Each bead of glue is deposited by a nozzle 300, FIG. 11. The glue may be a "hot melt", supplied from a reservoir, not shown.

The knife assembly 290 includes a rotary knife holder 301 and an opposed rotary anvil 302. The knife holder 301 carries two 180° displaced knives 303, each effective to sever the juxtaposed webs transversely, that is, at right angles to the glue bead. The transverse cuts are made repeatedly of course, cutting at the head and foot of successive pre-form books, resulting in a constant stream of four juxtaposed sheets to be folded along the glue line. Head-to-foot registration of the juxtaposed pages is maintained by the glue. The product produced at the knife station is to be folded along the glued back; the preferred manner of accomplishing this will now be described.

As will be apparent in FIG. 10, the path of movement of the web material from the roll stand to the rotary knife is parallel to the saddle conveyor, but this direction is turned 90° at the transfer station incidental to delivering the sheets to the folder station where the sheets joined by glue are folded into signature form. The means for accomplishing this transfer are shown in FIGS. 12 and 13.

Figures 12, 13:
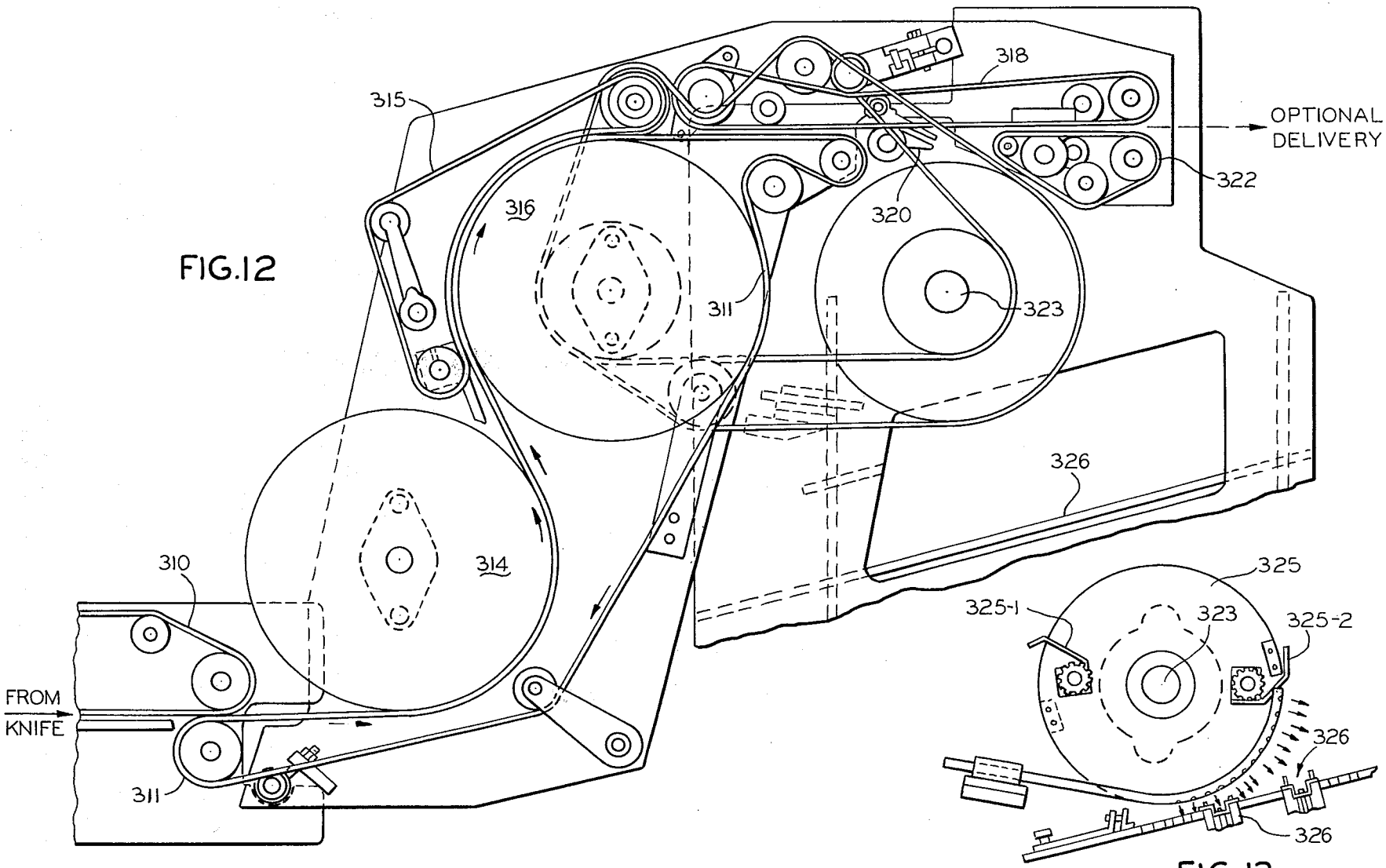
FIG. 12 is an elevation of means employed to transfer sheet material from the knife delivery to the folder.
FIG. 13 is a side elevation of a delivery cylinder.

The book or signature pre-forms, constantly separated from the webs by the rotary knife, are fed horizontally one by one to the bight of engaged feed belts 310 and 311, FIG. 12, the latter being trained around rotary guide discs 314 so that the glued, registered sheets are elevated and moved upwardly. This gain in altitude is accomplished because the roll stand and rotary knife are at one level for convenience while the transfer conveyor (326, hereinafter) is at another level.

Another series of feed belts as 315 are opposed to the belts 311 and belts 311 are extended to another set of rotary guide discs 316. From thence the pre-form signatures or books are fed forwardly by means of additional feed belts 318 opposed to the feed belts 311, and at this point a shiftable guide means as 320 is selectively operable to deliver the sheet material either to a transfer cylinder or, optionally, to feed belts 322 which are opposed to the feed belts 318.

The aforementioned transfer cylinder to which the books may be delivered by guide 320 is co-axial with shaft 323, FIG. 12, and the transfer cylinder itself, 325, is shown in FIG. 13, positioned above the transfer conveyor 326 which transfers the books to the folding station.

The transfer cylinder 325 is similar in nearly all respects to the cylinder means 25 described above in connection with FIG. 8, except of course that the sheet material fed to the cylinder 325 is not fed from a hopper or supply pocket but rather arrives from the knife station. Consequently, the details of the transfer cylinder 325 will not be repeated except to note that the grippers thereon 325-1 and 325-2, identical to the grippers 20-1 and 20-2, FIG. 8, are displaced 180° and are effective to deposit two signature pre-forms on the conveyor 326 during each cycle of rotation. Furthermore, the transfer conveyor 326, similar to the conveyor 75 described in connection with FIGS. 4 and 5, is disposed beneath the transfer cylinder to receive the sheet material released therefrom, transferring the same forwardly to the folding station.

It will be recognized that the pre-form books or signatures, four sheets thick and not yet folded, are inverted by the transfer cylinder 325. In other words, the pages that were uppermost on delivery to the feed belts 310 and 311 are lowermost on the transfer conveyor 326; see FIG. 21. This inversion will not take place in the event the selectively operable guide 320, FIG. 12, is in an elevated position for directing the glued sheet material to the optional feed means 318–322. Such optional sheet delivery may be used under many different circumstances as for instance where the saddle conveyor, instead of occupying the center line shown in FIG. 10, is turned 90° to be positioned adjacent the transfer station, represented by cylinder 325. Another instance of utilizing the optional delivery, FIG. 12, is in the event the web material repeats alternately different books, rather than a constant flow of identical books, requiring separation into divergent streams.

Figures 14, 15A, 15B, 15C:
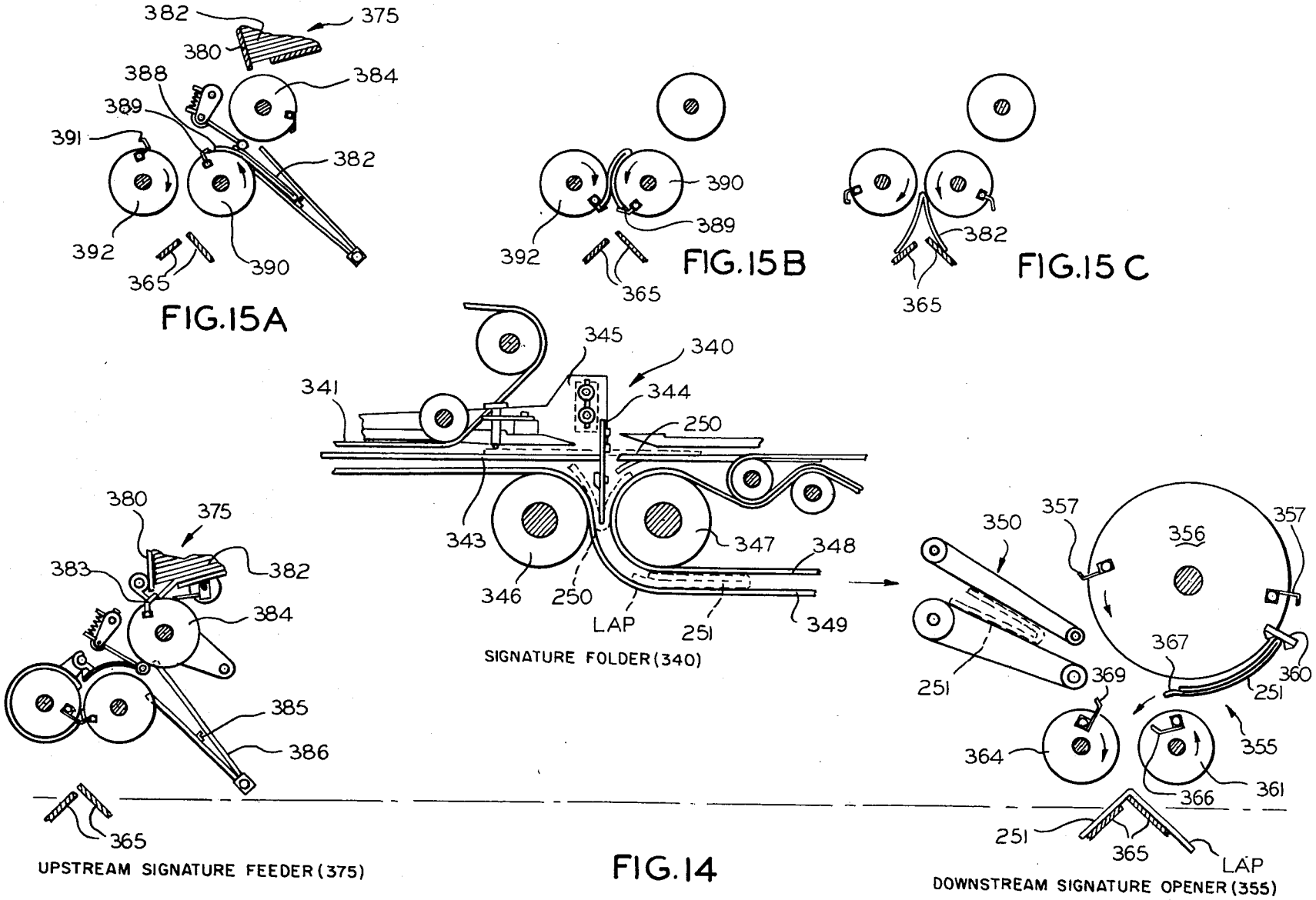
FIG. 14 is an assembly view of a folder, a signature feeder and a signature opener.
FIGS. 15A, 15B and 15C are sectional views showing the sequence of signature delivery.

Assuming the production circumstance where the flow from the knife is repeatedly an identical book, the cylinder 325, FIG. 13, is active and the book material 250, FIG. 22, presents the register openings 295 in a trailing position in the course of transfer to the folding means 340 shown in FIG. 14.

The folding means 340, FIG. 14, is disclosed in full detail in U.S. Pat. No. 3,749,394. Thus, the unfolded sheet material, still maintained in registry by the glue, is fed forwardly by feed belts as 341 until the leading end is engaged with a stop, not shown, so that the sheet assembly 250 spans the gap presented by a pair of spaced support plates 343 and 344. At this time a folder or tucker blade 344 carried by a reciprocal support 345 is in an uppermost position; it then descends to force the signature material between a pair of folder rollers 346 and 347. The space between the folder rollers is exaggerated in FIG. 14 for clarity. A neat, sharp fold is indeed made. In fact, a sharp fold is facilitated by the glue beads which are still somewhat moist. The folder blade support is cycled constantly by a cam, not shown.

The emergent folded material 251, FIG. 14, is now of conventional signature appearance and the book or signature in its folded state is advanced by feed belts 348 and 349 to an intermediate feeder 350 associated with a signature divaricating means 355.

The signature divaricator 355 includes a transfer cylinder 356 having a pair of grippers 357, effective in each half-cycle of the machine to extract a signature properly positioned by the in-feeder 350, withdrawing the signature therefrom and moving it counterclockwise as viewed in FIG. 14 until the backbone or folded side of the signature is engaged with and released to a register gauge 360.

A pair of opening or divaricating cylinders 362 and 364 are located beneath the transfer cylinder 356. Cylinder 362 carries a gripper 366 effective to clamp the extended lap margin 367 of the signature positioned by the register gauge 360, extracting signature 251. Gripper 369, on the other hand, is effective to clamp the short margin or leg of signature 251 and together the two grippers 366 and 369 spread the two sections of the signature to fit the saddle 365 of the saddle conveyor.

The signature opening means 355 shown in FIG. 14 is of conventional and well known form consistent with one objective of the present invention to conserve an investment in existent production equipment and in fact the production method or system of the present invention assumes that the books emerging from the folder may optionally be gathered with other signatures and delivered by conventional equipment to the saddle conveyor, although such option may not always be employed. In this regard it has already been noted in connection with FIG. 10 that there may be one or more signature feeders 375 of conventional form located upstream of the book opener station. These additional, conventional feeders are sometimes referred to as "pocket" feeders, and there may be a similar cover feeder 376 downstream of the book opener station constituting the last signature to be added.

In any event, the upstream signature feeders may employ the opening means and operate on the principle shown in FIGS. 14, 15A, 15B and 15C wherein the sequence of signature feed and gathering, shown in detail, is virtually identical to the manner in which the book 251 is handled by the divaricating means 355.

Thus, as shown in FIGS. 14 and 15A, the upstream signature feeder 375 may include a supply hopper or pocket 380 containing a supply of additional pre-folded signatures 382. The backbone of each signature is in a forward or leading position and is pulled downwardly by a suction cup, not shown, so that the signatures may be extracted one by one by a gripper 383 carried by a rotatable transfer cylinder 384 which, during one cycle of revolution, extracts a signature 382 from the pocket 380 and releases it to a stop 385, FIG. 14, presented by a register gauge 386 as described in U.S. Pat. No. 3,087,721. This is done by the gripper 383 clamping the depressed backbone of the signature in the pocket 380, FIG. 14. The signature thus withdrawn from the pocket 380 and released to the register gauge 386 has the lap margin 388 thereof, FIG. 15A, in an extended or free attitude, in position to be clamped by a gripper 389 on an extractor cylinder 390. In timed relation, a gripper 391 on an opening cylinder 392 is effective, as shown in FIG. 15B, to clamp the short leg or side of the signature 382, all as disclosed in U.S. Pat. No. 3,087,721.

As in the instance of the opening cylinders 362 and 364, FIG. 14, the cylinders 390 and 392 are positioned above the saddle 365 of the saddle conveyor and once the legs of the signature have been sufficiently spread, FIG. 15C, the two grippers 389 and 391 are opened to release the signature 382 for gravity drop to the conveyor saddle 365.

Figure 17:
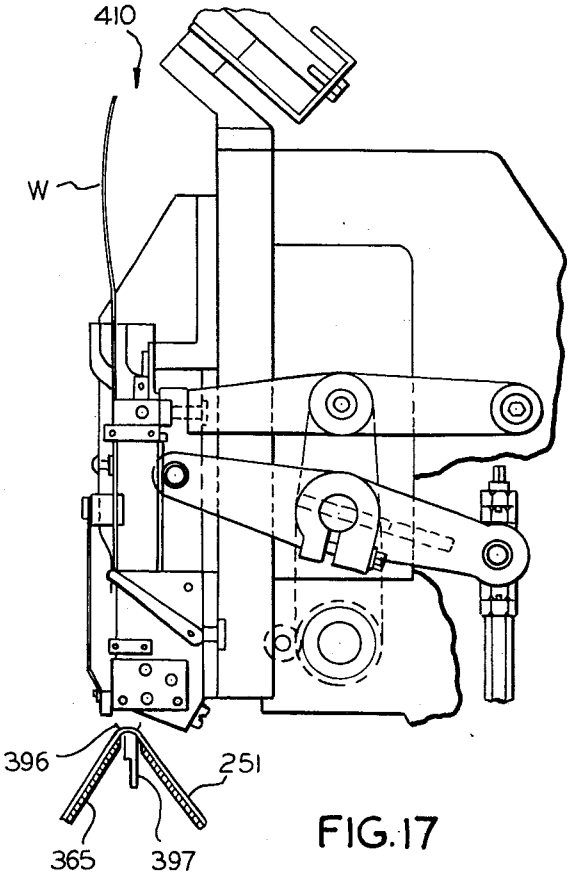
FIG. 17 is an elevation of the stitcher head.
Figure 16:
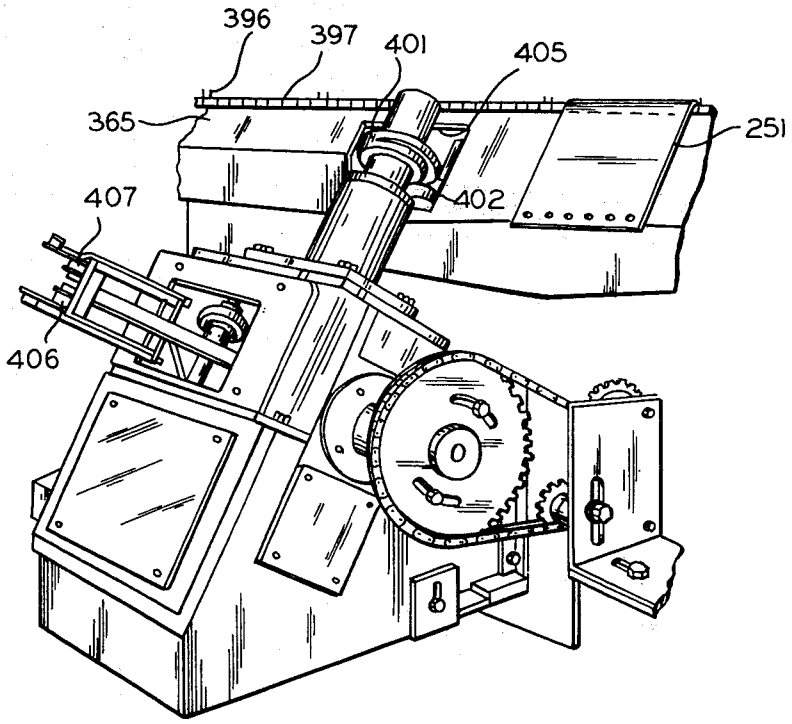
FIG. 16 is a perspective view of the caliper.

Under the embodiment of the invention thus far described it will be realized that one or more signatures may be collected on the saddle conveyor upstream of the book opener station and if this is so then book 251, FIG. 14, will be gathered on top of the signatures which were collected upstream. The book may be completed by a cover obtained from the cover feeder station 376. The signatures on the saddle 365 have the folded back uppermost. Feeder pins as 396, FIGS. 16 and 17, on a conveyor chain 397 project upwardly through a slot at the top of the saddle 365 and are effective to engage the trailing edge of the signatures, thereby aligning the trailing edges as an incident to moving the corresponding book to a caliper, FIG. 16, and from thence to the stitcher, FIG. 17, as will now be described.

The caliper station, as shown in FIG. 10, is upstream of the stitcher station. The caliper device, FIG. 16, comprises a pair of rollers or discs 401 and 402 opposed to one another within an opening 405 formed in one side of the conveyor saddle 365. The book 251 is transported between the rollers 401 and 402, where the thickness is measured and, as disclosed in U.S. Pat. No. 3,191,925, one or the other of a pair of control switches 406 and 497 is operated in the event the calipered book is one of incorrect thickness. The information represented by actuation of a switch 406 or 407 is stored during those cycles of the machine required for movement of the calipered book to the stitcher head 410 shown in FIG. 17, whereupon the stitcher head is disabled from applying staples to the backbone of the book. Disabling of the stitcher may be accomplished by disabling the wire feed gripper as disclosed in U.S. Pat. Nos. 3,191,925 and 3,305,154, or it may be done by displacing the wire W, FIG. 17, from the wire gripper as disclosed in U.S. Pat. No. 3,275,210.

The caliper is of particular importance in detecting incorrect books due to splicing the leading ends of fresh webs rolls to the trailing ends of the exhausted webs. The splice, of course, represents an overlap of web ends and renders the book entirely unacceptable.

The saddle conveyor chain 397 is of the endless type. Its forward travel from the feeders 375 terminates at the point where the book is removed one cycle from the stitcher head and at this point the conveyor chain starts its return run or flight. The stitched book is advanced through and from the stitcher station to the trimmers, but an incorrect book is first ejected as will now be described.

The saddle 365 extends to the ejector station. The saddle has an open slot at the top as already noted. Reciprocal pusher fingers, not shown, are operative in the slot to move the stitched book into, through and out of the stitcher and into the ejector station.

Figure 25:
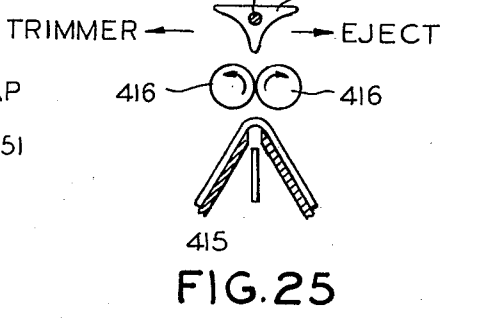
FIG. 25 is a detail schematic view of a selector means.

Referring to FIG. 25, a vertically moveable tucker blade 415 identifies the ejector station, FIG. 10. The tucker blade 415 is effective to transport the stitched book upwardly into the bight between a pair of upfeeding rollers 416 which feed the book to an ejector guide finger 418. The ejector guide finger 418 is carried on a rock shaft 419 which may be oscillated clockwise or counterclockwise depending upon whether the book is to be trimmed or ejected. Thus, as noted above, a book of incorrect thickness is to be ejected, particularly in the instance of a book containing web end splices. Accordingly, when the caliper detects such an imperfect book, this information is stored until the book arrives at the ejector station, whereupon the ejector finger 418 is rocked clockwise as viewed in FIG. 25, ejecting the book and preventing its being delivered to the trimmer. On the other hand, if the book is acceptable then the ejector finger 418 is rocked counterclockwise, guiding the book to infeeding tapes 425, FIG. 18, which advance the book to a collector wheel 426 as a preliminary to positioning the book for trimming off the lap edge which contains the register openings.

Figure 18:
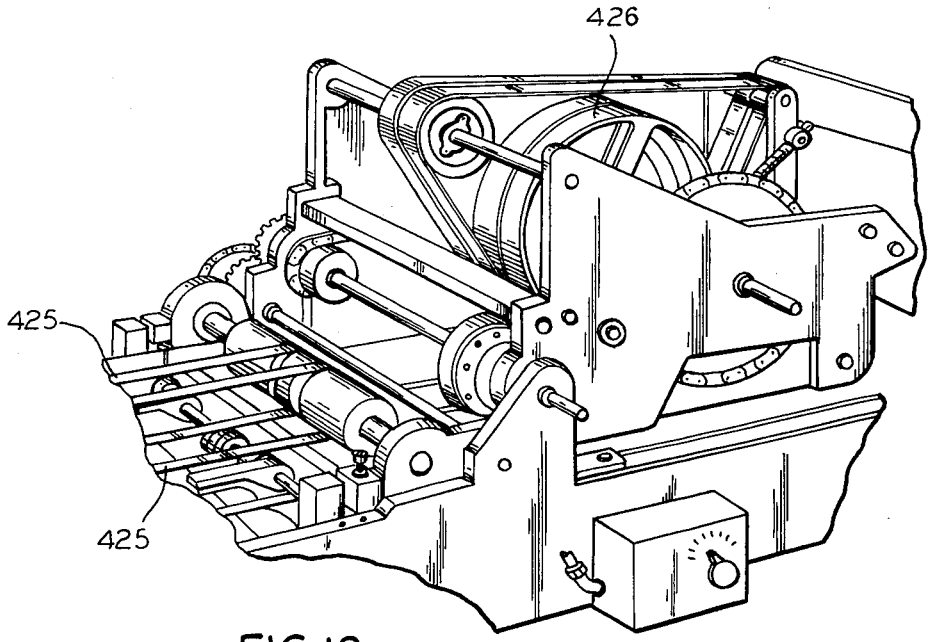
FIG. 18 is a fragmentary perspective view of a trimmer and associated collater.
Figure 19:
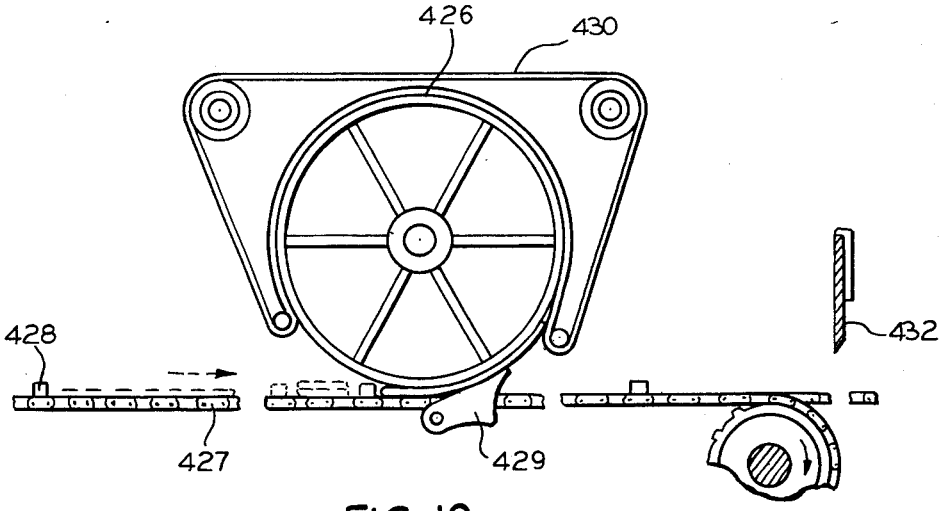
FIG. 19 is an elevational view of a portion of the structure shown in FIG. 18.

The trimmers, both in the first trimming station and second trimming station, may be of any desired form; head and foot trimming may not always be necessary. The trimmer shown in FIGS. 18 and 19 is of the kind disclosed in Patent No. 3,520,395 but other forms may be used.

The infeeding tapes 425 feed the book to be trimmed to a conveyor chain 427 having feeder lugs 428. A guide finger 429, for each alternate book, is elevated to the position shown in FIG. 19, guiding the alternate book upward to the collector wheel 426 which, in cooperation with bands 430, elevates the book and inverts it, returning it to the conveyor 427 where it is dropped atop the trailing book. In this manner, as explained in U.S. Pat. No. 3,520,395, two books are juxtaposed on the conveyor 427 and are delivered forwardly to a reciprocal knife 432 which is effective to trim the trailing, lap margins of the juxtaposed books, thereby removing the lap as waste paper.

Finally, the books are advanced to a second trimmer station where the head and foot are neatly trimmed.

Timing

The operating members at the roll stand and knife delivery station, FIG. 10, are driven by a shaft 265 in turn driven through proper gearing (not shown) by a shaft 266. Shaft 266 drives the conveyor chain associated with the saddle conveyor and in turn is driven through a coupling 270 and gear reducer 272. The gear reducer 272 is driven by a belt 273 in turn driven by a motor 276.

The gear reducer 272 is also used to drive a shaft 277 which drives the stitcher heads, the ejector and the equipment at the trimming station. A shaft 278 for driving the caliper is geared to shaft 277.

The equipment at the transfer station and the folder are driven through a clutch 279 which receives its input from shaft 266.

Shaft 266, it will be seen, may be driven through the gear reducer 272 at any selected speed, thereby determining the rate of travel of the conveyor. Shaft 277 will be driven at the same speed, and consequently shaft 278 is synchronized to shaft 266. This is equally true of shaft 265 and consequently, by means of gears, there is assurance that the rate of delivery of web material to the knife station, from which a book is to be made, is the same as the rate at which the saddle conveyor moves books past the book opener station. By the same token since the folder, transfer conveyor and inverting cylinder 325 are driven through clutch 279, the rate of delivery of signatures emerging from the folder is the same as the rate at which the saddle conveyor moves books to and through the book opener station. It may be noted that since the cylinder 301 has two knives and since the cylinder 325 carries two grippers, these rotary members are geared to turn at half the speed of shaft 266. Thus, the rotary knife cuts two complete books (head and foot so to speak) per 360° while cylinder 325 delivers two books per 360° to the transfer conveyor.

It may be further noted in connection with timing that the diverting finger 320, FIG. 12, may be operated alternately to direct signature pre-forms to a second cylinder (not shown) as 325 along a path co-axial with the path of the registered sheets emerging from the knife station. This second cylinder would deliver pre-forms to a second transfer conveyor as 326 leading to a second folder as 340. In other words there would be several parallel paths 326, FIG. 10, each eventually delivering a divaricated signature to the saddle conveyor or other gathering device and in this sense the scheme would be similar to that shown in FIG. 4. Such a scheme would be employed in those instances where the printed rolls on the spindles are printed with alternate signature pages.

Flat gathering may also be utilized where perfect binding is desired; again, the signatures are gathered in juxtaposed relation and bound at their backs, but a square back results.

Splicing

Figure 26:
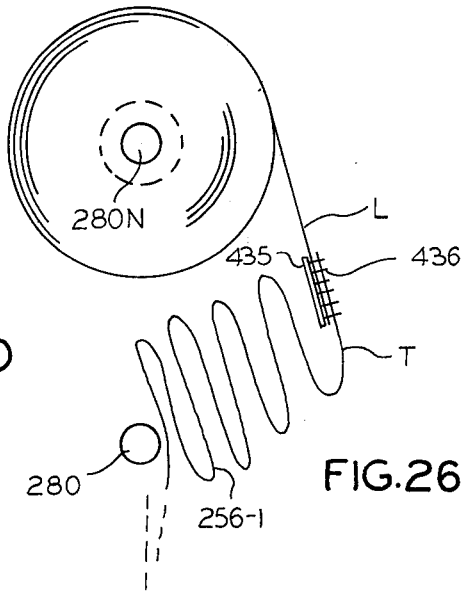
FIG. 26 is a detail view of means for splicing.

In an instance where it is desired to operate the machine continuously without stopping the machine to change rolls, this can be accomplished by a slight modification at the roll stand enabling the leading end of a fresh web on a spindle to be spliced to the trailing end of the web being exhausted. Referring to FIG. 26, the machine operator, detecting that spindle 280 holding web 256-1 is nearly exhausted, has festooned the remaining twenty or so feet of web 256-1. A new spindle, 280N uppermost on the spindle support, FIG. 26, supports a fresh roll of the printed web. A fixture plate 435 having register pins 436 spaced to fit the register openings in the trailing end T of web 256-1 and in the leading end L of the new web is used to bring the two ends together in overlapping relation, whereupon the operator simply applies a length of splicing tape cross-wise of the ends to join the web ends. Printed webs of the kind involved have registering indicia (color codes) along one side which may be used to assure the splice is made at the proper gauge, that is, to assure the web ends are so overlapped that the new web is indeed a precisely pages continuation of the other.

Modified Flow for Different Books

In actual practice the webs referred to above have a 17½ inch width (nominal 17 inches herein) which, allowing for trimming of the lap edge containing the register openings, constitutes two pages each of 8½ inch width. The knife cuts the webs at 11⅜ of an inch interval (nominal 11 inches herein) which, allowing for head and foot trimming, means a head-to-foot length of 11 inches. In other words, the signatures, once folded and trimmed, are of standard 8½ × 11 size.

Many publishers, however, are concerned with books of another size, not necessarily 8½ × 11. The system of the present invention will satisfy diverse requirements merely by an alteration in flow and, in some instances, applying the glue bead transversely rather than longitudinally between juxtaposed webs.

Figure 27:
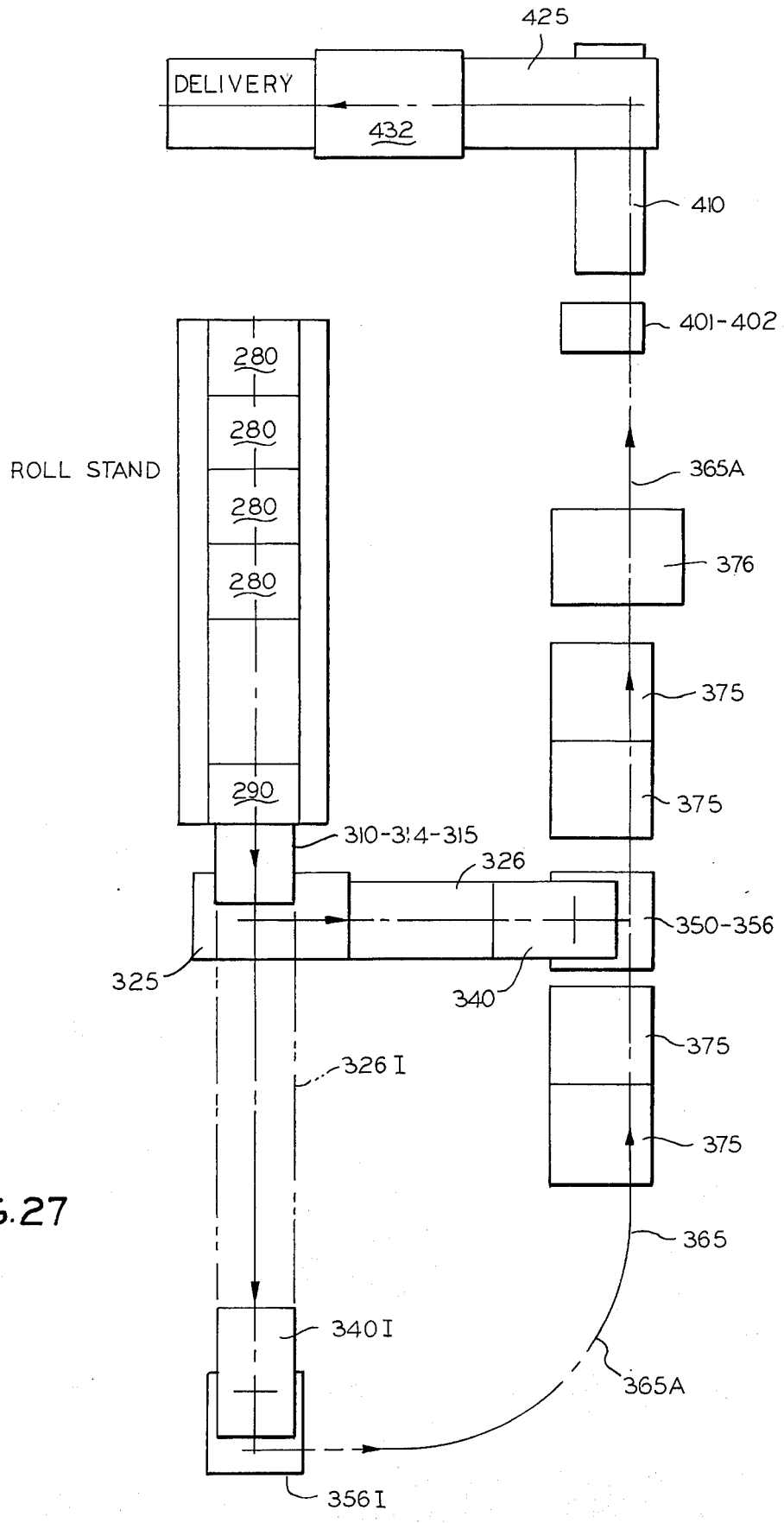
FIG. 27 is a diagrammatic view of a modified form of floor plan.

Referring to FIG. 27, the roll stand, cutting cylinder 290 and transfer cylinder 325 are of the form described above, but in this instance web travel is in the direction of the arrow. Folder 340 is of the form described above and receives signatures inverted by the transfer cylinder 325 and transferred to the folder by the transfer conveyor 326 as described above. In fact, 8½ × 11 books 250 are produced precisely in the manner already described, FIG. 28, including the divaricating cylinder 356 for opening the signatures and depositing them on the saddle conveyor. The location of the glue bead is shown by dashed line, FIG. 28. It may be noted, however, that at all times the roll spindles may be supported at one side of the register belt, rather than above, the webs being delivered to the register belt by two turning bars. At all times, when delivering to a saddle conveyor, the folded product, of whatever size, has a lap margin.

Referring again to FIG. 27 the saddle conveyor and related gathering chain are identified by reference character 365, having a turn 365A extending to an optional divaricating cylinder 356I of the kind already described.

An optional transfer conveyor 326I extends to the second divaricating cylinder 356I along an axis coaxial with web travel, FIG. 27.

In order to handle books of another size (I, FIG. 29) the diverting finger 320, FIG. 12, of the transfer cylinder is set to deliver signature pre-forms to the optional transfer conveyor. The reason will now be explained.

The web material (pre-printed and paginated) supplied by the roll stand is again of nominal 17 inch width and the cutting cylinder cuts at nominal eleven inch intervals. However, the glue is applied transversely between the webs, FIG. 29, as shown by the dashed line in FIG. 29. An optional folder 340I is interposed between conveyor 326I and cylinder 356I, FIG. 27, folding along the glued back which is the dashed line in FIG. 29. The signature, 5½ × 17, is delivered to the optional divaricator 356I in turn for delivery to the saddle conveyor in the manner already described except that a folder blade of greater length is used, the fold being made so that a lap edge is created. Also, in this instance, book I is a twin book of sections (A) and (B) which will be separated in a known manner at the trimming station. The sheet product delivered to conveyor 326I is not inverted by cylinder 325; consequently pagination is different compared to book 251 described above. This is equally true of the other form of book now to be described.

Another form of book (II) is possible, 11 × 17 as shown in FIG. 30, using the same flow path for book (I) but one knife blade is removed from the cutting cylinder 301 so that the juxtaposed webs are cut at every (nominal) 22 inch interval, folded to 11 × 17 size as shown in FIG. 30.

In an actual run of the machine, FIG. 27, only one folder and the related divaricator will be active, depending upon whether the transfer cylinder 325 is set to deliver books to folder 340 or the optional folder 340I. However, the pockets 375 can be utilized in all circumstances, regardless of whether signatures are being delivered from folder 340 to the related divaricator 356 or from folder 340I to the related divaricator 356I.

Figure 29:
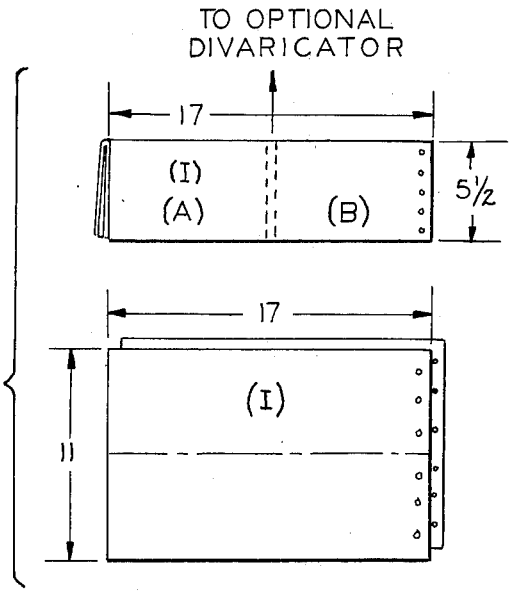
FIGS. 28 and 29 are schematic views of modified book flow.
Figure 28:
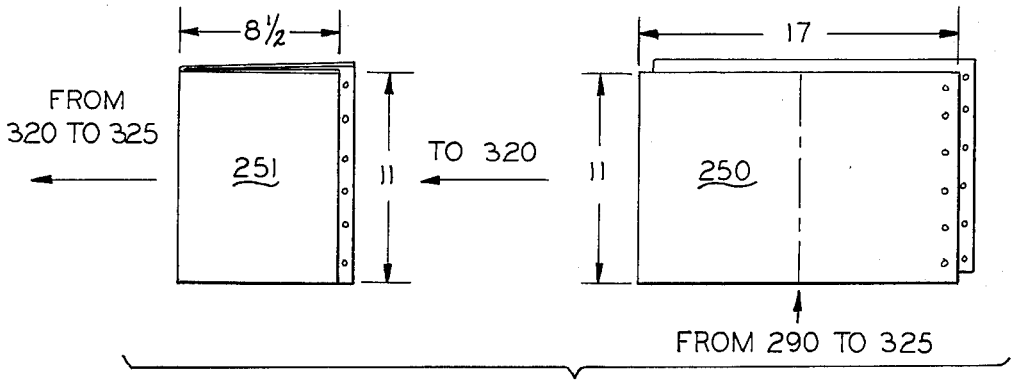

In FIGS. 28, 29 and 30 only two webs are shown as a matter of convenience; there may be more, of course.

What is claimed is:

1. A machine for producing signatures and forming trimmed books therefrom comprising: a roll stand having spaced spindles for supporting rolled webs of paginated printed material at least of double page width, said webs being punched along at least one edge with equidistantly spaced openings enabling the webs to be registered for proper pagination head-to-foot, a pin register belt disposed to travel beneath the spindles and having the register pins thereof spaced to register with the holes in the webs, feed means to withdraw the webs from their rolls, glue means for applying glue longitudinally between the webs approximately midway of the transverse web width, a knife at one end of the pin register belt, guide means to continuously place the webs one juxtaposed on another on the traveling pin register belt which advances the justaposed webs to the knife where the webs are severed transversely to produce juxtaposed sheets of multi page width joined by a glue joint, a folder for folding the juxtaposed sheets along the glue joint to produce a signature with a back and having the openings presented at an extended lap margin opposite the resultant back of the signature, means to transfer the juxtaposed sheets from the knife to the folder, a saddle-type conveyor adjacent the folder, means to deliver the signature from the folder to the saddle conveyor including a lap opener for divaricating the folded signature so the backbone thereof fits the saddle conveyor, and a trimmer downstream of the lap opener effective to separate the lap margins containing the register openings as waste.

2. A machine according to claim 1 having a separate signature feeder disposed at a point along the saddle conveyor spaced from the lap opener to deliver a second signature to the conveyor, timing means to time signature delivery so that the two signatures are gathered together on the conveyor one atop another, and means to stitch the gathered signatures.

3. A machine according to claim 1 having caliper means disposed between the lap opener and the trimmer to detect an imperfect signature due to the trailing end of an exhausted web spliced to the leading end of a fresh web, and means in advance of the trimmer to eject the imperfect signature.

4. A machine according to claim 2 having caliper means disposed between the lap opener and the trimmer to detect an imperfect signature due to the trailing end of an exhausted web spliced to the leading end of a fresh web, and means in advance of the trimmer to eject the imperfect signature.

5. A machine for producing signatures and forming trimmed books therefrom comprising: a roll stand having spaced spindles for supporting rolled webs of paginated printed material at least of double page width, said webs being punched along at least one edge with equidistantly spaced holes enabling the webs to be registered for proper pagination head-to-foot, a pin register belt disposed to travel along a first path beneath the spindles and having the register pins thereof spaced to register with the holes in the webs, feed means to withdraw the webs from their rolls, glue means for applying glue longitudinally between the webs substantially midway of the transverse web width, a knife at one end of the pin register belt, guide means to continuously place the webs one juxtaposed on another on the pin register belt which advances the juxtaposed webs to the knife where the webs are severed transversely to produce juxtaposed sheets of multiple page width joined by glue, a folder for folding the juxtaposed sheets along the glue to produce a glued signature having the holes presented at an extended lap margin opposite the resultant backbone of the signature, feed means to transfer the sheets from the knife to the folder along a path substantially at right angles to the first-named path, a saddle-type conveyor adjacent the folder, said conveyor extending along a path substantially parallel to the first-named path, means to deliver the signature from the folder to the saddle conveyor including a lap opener for divaricating the folded signature so the backbone thereof fits the saddle conveyor, and a trimmer downstream of the lap opener effective to separate the lap margins containing the register openings as waste.

6. A machine according to claim 5 having a separate signature feeder disposed at a point along the saddle conveyor spaced from the lap opener to deliver a second signature to the conveyor, timing means to time signature delivery so that the two signatures are gathered together on the conveyor one atop another, and means to stitch the gathered signatures.

7. A machine according to claim 6 having caliper means disposed between the lap opener and the trimmer to detect an imperfect signature due to the trailing end of an exhausted web spliced to the leading end of a fresh web, and means in advance of the trimmer to eject the imperfect signature.

8. A machine according to claim 5 having caliper means disposed between the lap opener and the trimmer to detect an imperfect signature due to the trailing end of an exhausted web spliced to the leading end of a fresh web, and means in advance of the trimmer to eject the imperfect signature.

9. A machine for producing signatures and forming trimmed books therefrom comprising: a roll stand having spaced spindles for supporting rolled webs of paginated printed material at least of double page width, means to unwind web lengths from their rolls, means to register the unwound web lengths for proper pagination in heat-to-foot juxtaposed relation, glue means for applying glue longitudinally between the unwound web lengths along a glue line laterally displaced from the center line of the webs, a knife for severing the webs transversely to produce juxtaposed sheets of two-page width joined by glue, means to advance the juxtaposed registered webs to the knife, means for folding the juxtaposed sheets along the glue line to produce a signature having an extended lap margin, means to transfer the juxtaposed sheets from the knife to the folding means, a saddle-type conveyor adjacent the folding means, means to deliver the glued signature from the folding means to the saddle conveyor including a lap opener for divaricating the glued signature to fit the saddle conveyor, and a trimmer downstream of the lap opener effective to separate the lap margins.

10. A machine according to claim 9 having a separate signature feeder disposed at a point along the saddle conveyor spaced from the lap opener to deliver a second signature to the conveyor, timing means to time signature delivery so that the two signatures are gathered together on the conveyor one atop another, and means to stitch the gathered signatures.

11. A machine according to claim 10 having caliper means disposed between the lap opener and the trimmer to detect an imperfect signature due to the trailing end of an exhausted web spliced to the leading end of a fresh web, and means in advance of the trimmer to eject the imperfect signature.

12. A machine according to claim 9 having caliper means disposed between the lap opener and the trimmer to detect an imperfect signature due to the trailing end of an exhausted web spliced to the leading end of a fresh web, and means in advance of the trimmer to eject the imperfect signature.

13. A method for producing signatures and forming books therefrom comprising: supporting rolled webs of paginated printed material of double page width, said webs being punched along at least one edge with equidistantly spaced holes enabling the webs to be registered for proper pagination head-to-foot, unwinding the rolled webs and applying a bead of glue longitudinally between the webs, substantially midway of the traverse web width, delivering the glued webs in juxtaposed registered form to a knife, cutting the juxtaposed webs traversely to produce juxtaposed sheets of two-page width joined by a bead of glue, folding the juxtaposed sheets along the glue bead to form a signature having a short margin and having the holes presented at an extended lap margin, divaricating the lap margin and the short margin to open the folded signature, delivering the opened signature on a saddle-type conveyor, and conveying the signature downstream to a trimmer where the lap margin is severed as waste.

14. A method according to claim 13 including the step of delivering a second signature to the conveyor at a point spaced from the point of delivery of the first-named signature, delivering the signatures to the conveyor in timed relation so that one is gathered atop the other on the conveyor, and stitching the gathered signatures to form a book.

15. A method according to claim 13 including the step of splicing the trailing end of an exhausted web to the leading end of a fresh web, calipering the signatures on the conveyor to detect an imperfect signature containing the splice, and ejecting the imperfect signature upstream of trimming.

16. A method according to claim 14 including the step of splicing the trailing end of an exhausted web to the leading end of a fresh web, calipering the signatures on the conveyor to detect an imperfect signature containing the splice, and ejecting the imperfect signature upstream of trimming.

17. A method for producing signatures and forming books therefrom comprising: supporting rolled webs of paginated printed material having register holes along at least one edge of each web, withdrawing web lengths from the rolls and registering the web lengths in juxtaposed relation for proper pagination head-to-foot, applying glue to one of the webs between the pages thereof and joining the webs thereby in registered form at a glue joint, advancing the joined and juxtaposed webs to a knife where the juxtaposed webs are cut transversely to the glue joint to produce juxtaposed signature sheets of at least two-page width joined by glue, folding the sheets along the glue joint to produce a signature having a glued back and a lap margin with the register holes in the lap margin, opening the signature at the lap margin and delivering the opened signature to a saddle type conveyor, delivering a second signature to the saddle conveyor and timing delivery thereof so that the two signatures are gathered together one atop another on the conveyor, trimming off the lap margins and conveying the gathered signatures to a binder where the signatures are bound at their backs.

18. A method according to claim 17 including the step of splicing the trailing end of an exhausted web to the leading end of a fresh web, calipering the gathered signatures to detect an imperfect signature characterized by the splice, and separating the imperfect signature.

19. A machine for producing signatures and forming books therefrom comprising: a roll stand having spaced spindles for supporting rolled webs of paginated printed material wherein each web has register holes along one edge, means to withdraw web lengths from the rolls, means to register the withdrawn web lengths for proper pagination in head-to-foot juxtaposed relation, glue means for applying glue between the web lengths to join the web lengths in registered form at a glue joint, a knife and means to advance the juxtaposed webs to the knife along a predetermined path where the webs are severed to produce juxtaposed sheets joined by glue, a folder for folding the juxtaposed sheets along the glue to produce a signature having a back, the glue and knife means being positioned in cooperation with the folder so that the folder produces a signature with an extended lap margin containing the register holes, means to transfer the juxtaposed sheets from the knife to the folder, a saddle type conveyor adjacent the folder, means to deliver the signature from the folder to the saddle conveyor including a signature opener for divaricating the signature by means of the lap margin to fit the saddle conveyor, and means for removing the lap margins.

20. A machine according to claim 19 including a separate signature feeder disposed at a point along the saddle conveyor spaced from the signature opener to deliver a second signature to the conveyor, timing means to time delivery of the signatures so that the two signatures are gathered together on the conveyor one atop another, and means to bind the backs of the gathered signatures.

* * * * *